US007986895B2

(12) United States Patent
Tsujita

(10) Patent No.: US 7,986,895 B2
(45) Date of Patent: Jul. 26, 2011

(54) PRINTING APPARATUS, METHOD FOR CONTROLLING THE SAME, AND COMPUTER-READABLE STORAGE MEDIUM

(75) Inventor: Kosuke Tsujita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/493,203

(22) Filed: Jun. 28, 2009

(65) Prior Publication Data

US 2010/0003046 A1 Jan. 7, 2010

(30) Foreign Application Priority Data

Jun. 30, 2008 (JP) ..... 2008-170750

(51) Int. Cl.
*G03G 15/00* (2006.01)

(52) U.S. Cl. ..... 399/82; 399/43; 399/389

(58) Field of Classification Search ..... 399/43, 399/45, 75, 82, 85, 86, 389
See application file for complete search history.

(56) References Cited

U.S. PATENT DOCUMENTS 5,550,623 A * 8/1996 Tomita et al. ..... 399/83
5,828,461 A * 10/1998 Kubo et al. ..... 358/296
6,336,011 B1 1/2002 Sumio et al.

FOREIGN PATENT DOCUMENTS

CN 1128363 A 8/1996

* cited by examiner

*Primary Examiner* — David P Porta
*Assistant Examiner* — Benjamin Schmitt
(74) *Attorney, Agent, or Firm* — Canon U.S.A., Inc. IP Division

(57) ABSTRACT

An apparatus includes a printing unit configured to perform printing by a short edge feed mode or a long edge feed mode, an inputting unit configured to input a print job, a setting unit configured to set an upper-limit value of a number of sheets to be used for a job, and a control unit configured to control the printing unit to perform printing by the short edge feed mode if the number of sheets to be used for the print job is less than the upper-limit value, and to perform printing by the long edge feed mode if the number of sheets to be used for the print job is equal to or greater than the upper-limit value.

14 Claims, 15 Drawing Sheets

--Prior Art--

LONG EDGE FEED

SHORT EDGE FEED

PRINTING APPARATUS, METHOD FOR CONTROLLING THE SAME, AND COMPUTER-READABLE STORAGE MEDIUM

BACKGROUND OF THE INVENTION

1. Field of the Invention

The present invention relates to a printing apparatus that performs printing on sheets selectively supplied by a long edge feed and a short edge feed, a method for controlling the same, and a computer-readable storage medium.

2. Description of the Related Art

As discussed in the U.S. Pat. No. 6,336,011, there is a conventional printing apparatus that can perform printing on sheets supplied by a long edge feed or a short edge feed. The long edge feed is a sheet feeding method for conveying a sheet 601 with its long side positioned on the leading edge as illustrated in FIG. 6A. The short edge feed is a sheet feeding method for conveying a sheet 602 with its short side positioned on the leading edge as illustrated in FIG. 6B.

The time required for printing a single sheet according to the short edge feed is longer than the time required for printing the same sheet according to the long edge feed. Because, the time for print processing (e.g., charging, exposure, development, transfer, and fixing) applied on a sheet is proportional to the length of the sheet in the conveyance direction. More specifically, if the printing time (i.e., requisite time) for a sheet supplied by the long edge feed is referred to as 1, the requisite time for printing the same sheet supplied by the short edge feed is approximately 1.5.

If a total number of sheets is a few or a few dozen, the time required to obtain an output product (i.e., a print product) may not be so different. However, a print on demand (POD) printing system or apparatus is generally required to process a print job including printing of a large amount of sheets. Therefore, the above-described difference in the requisite time may have a significant influence on print performances.

SUMMARY OF THE INVENTION

According to an aspect of the present invention, an apparatus includes a printing unit configured to perform printing by a short edge feed mode or a long edge feed mode, an inputting unit configured to input a print job, a setting unit configured to set an upper-limit value of a number of sheets to be used for a job, and a control unit configured to control the printing unit to perform printing by the short edge feed mode if the number of sheets to be used for the print job input is less than the upper-limit value, and to perform printing by the long edge feed mode if the number of sheets to be used for the print job unit is equal to or greater than the upper-limit value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Figure 1:
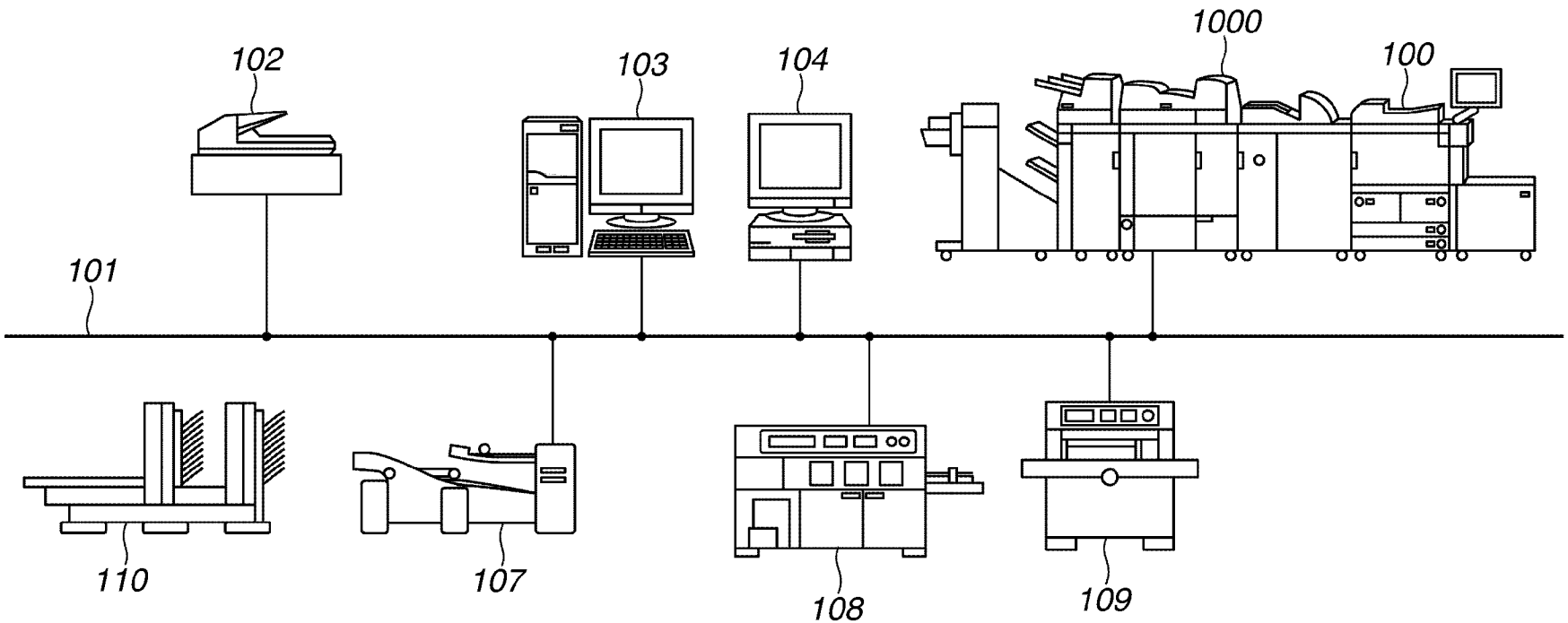
FIG. 1 illustrates a schematic configuration of a POD system including a printing system according to an exemplary embodiment of the present invention.

Various exemplary embodiments, features, and aspects of the invention will be described in detail below with reference to the drawings.

A printing apparatus 100 according to the present exemplary embodiment can perform printing on sheets that may be supplied by a long edge feed or a short edge feed (see FIGS. 6A and 6B) and can operate according to a predetermined print mode as described below. The printing apparatus 100 performs control for a print job that requires a large amount of sheets to be printed, which is not applied to a print job using a small amount of sheets, as described below.

For example, it is assumed that the printing apparatus 100 performs printing on a sheet of A4 portrait (i.e., performs printing on a sheet supplied by the long edge feed), and completing printing for the A4 portrait may takes 1 second. It is further assumed that the printing apparatus 100 performs printing on a sheet of A4 landscape (i.e., performs printing on a sheet supplied by the short edge feed). In this case, the latter A4 sheet is longer than the former A4 sheet in the lateral direction (i.e., the sheet conveyance direction) and therefore takes a longer time to complete the printing. The time required for completing printing of the latter A4 sheet (i.e., the printing by the short edge feed) becomes 1.5 seconds (=1 sec×1.5) when the printing by the long edge feed takes 1 second as described above.

Considering the foregoing, it is further assumed that there is a print job that requires a total of ten sheets. A print volume of this job is relatively small. If the printing apparatus 100 processes the print job by the long edge feed, the requisite time for thoroughly completing the print job becomes 10 seconds (=10 sheets×1 second). On the other hand, if the printing apparatus 100 processes the print job by the short edge feed, the requisite time for thoroughly completing the print job becomes 15 seconds (=10 sheets×1 second×1.5). As described above, if a target job to be processed has a small amount, the difference of five seconds may not have a significant influence on the productivity of the printing apparatus 100.

However, a POD system (e.g., a system according to the present exemplary embodiment illustrated in FIG. 1) is generally required to process a print job whose print volume is very large (e.g., 6000 sheets). If the printing apparatus 100 processes this job by the long edge feed, the requisite time for thoroughly completing the print job becomes 6000 seconds (=6000 sheets×1 second). On the other hand, if the printing apparatus 100 processes the print job by the short edge feed, the requisite time for thoroughly completing the print job becomes 9000 seconds (=6000 sheets×1 second×1.5). As described above, if a target job to be processed has a large amount, the difference becomes 3000 seconds (=50 minutes) and significantly deteriorates the productivity of the printing apparatus 100.

The present exemplary embodiment intends to appropriately control long edge feed printing and short edge feed printing for each target job to be processed. More specifically, a control unit 205 of the printing apparatus 100 performs printing by the long edge feed if the number of sheets to be used for a target print job is equal to or greater than a predetermined value.

The control unit 205 further performs printing according to a print mode determined based on print conditions set by a user for the target print job if the number of sheets to be used for the target print job is less than the predetermined value. Thus, the present exemplary embodiment can improve the productivity of the printing apparatus 100 without performing meaningless processing. The control according to the present exemplary embodiment is described below in detail with reference to FIGS. 1 to 3.

FIG. 1 illustrates a schematic configuration of a POD system including a printing system according to the present exemplary embodiment of the present invention. The POD system includes a printing system 1000, a scanner 102, a server computer (PC) 103, and a client computer (PC) 104 which are mutually connected via a network 101. The POD system further includes a folding machine 107, a case binding machine 108, a cutting machine 109, and a saddle stitch binding machine 110.

The server PC 103 can manage data transmitted to or received from various apparatuses connected via the network 101. The client PC 104 can transmit image data via the network 101 to the printing apparatus 100 of the printing system 1000 or the server PC 103.

The folding machine 107 can fold sheets printed by the printing apparatus 100. The case binding machine 108 can perform case binding for the sheets printed by the printing apparatus 100. The cutting machine 109 can cut the sheets printed by the printing apparatus 100, for each sheet bundle including a plurality of sheets. The saddle stitch binding machine 110 can perform saddle stitch binding for the sheets printed by the printing apparatus 100.

In the present exemplary embodiment, the printing apparatus 100 functions as a bookbinding processing apparatus, although the bookbinding processing apparatus of the present invention is not limited to the printing apparatus 100. For example, the server PC 103, the client PC 104, or a post-processing apparatus (e.g., the folding machine 107, the case binding machine 108, the cutting machine 109, and the saddle stitch binding machine 110) may function as the bookbinding processing apparatus. When a user uses the folding machine 107, the case binding machine 108, the cutting machine 109, or the saddle stitch binding machine 110, the user takes the printed sheets out of the printing apparatus 100 of the printing system 1000 and set the sheets on the selected machine that executes designated processing.

The above-described apparatuses constituting the POD system, except for the saddle stitch binding machine 110, are mutually connected via the network 101 and can perform data communications with each other. The folding machine 107, the case binding machine 108, the cutting machine 109, and the saddle stitch binding machine 110, if they receive printed sheets from a printing apparatus other than the printing apparatus 100, can perform post-processing on these printed sheets in the same manner.

Figure 2:
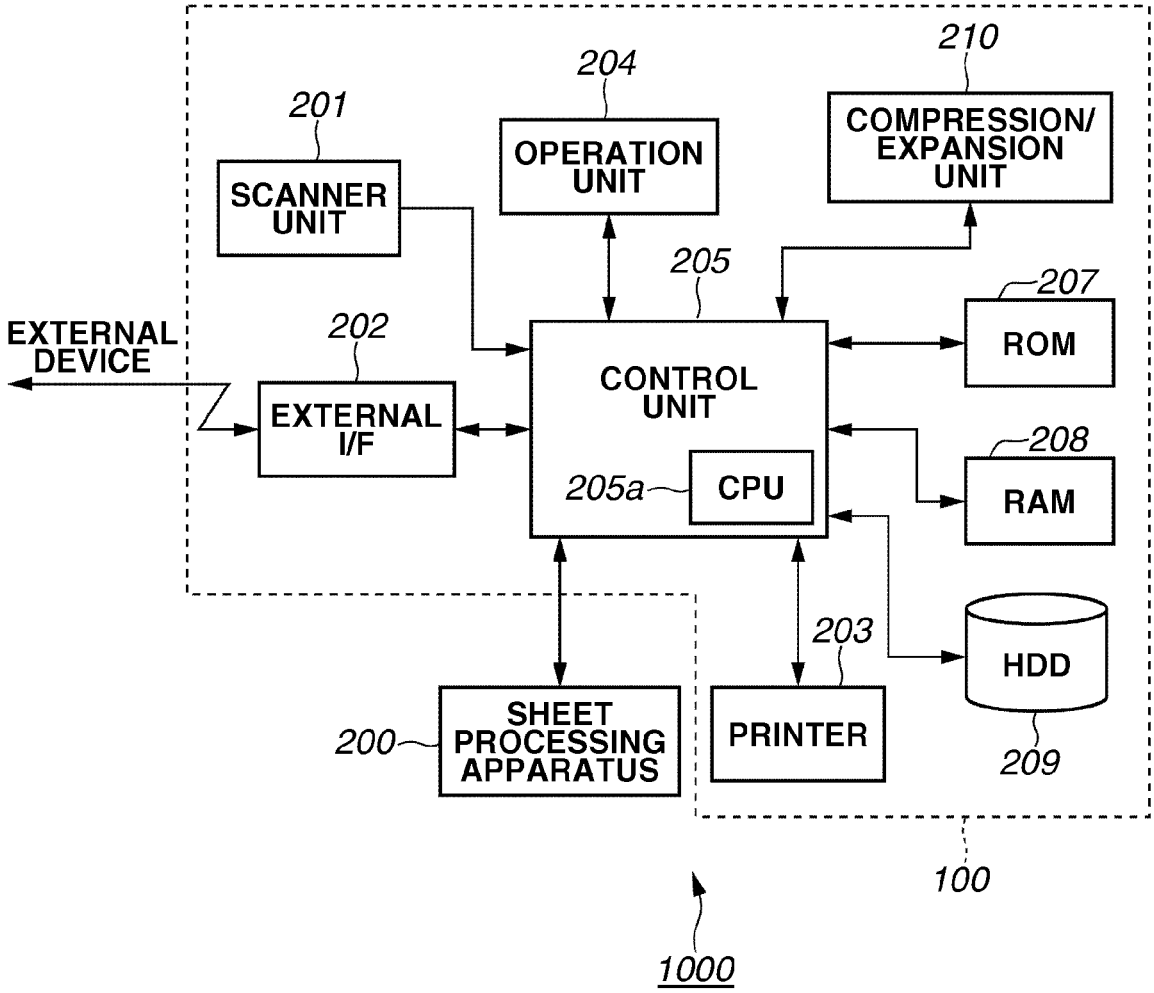
FIG. 2 is a block diagram of the printing system illustrated in FIG. 1.

FIG. 2 is a block diagram of the printing system 1000 illustrated in FIG. 1. The printing system 1000 includes the printing apparatus 100 and a sheet processing apparatus (i.e., a post-processing apparatus) 200. In the present exemplary embodiment, the printing apparatus 100 is a multifunction peripheral (MFP) that can perform a plurality of functions including a copy function and a printer function. However, the printing apparatus 100 may be as a single-functional printing apparatus (i.e., a printer) that performs only a copy function or a printer function.

The printing apparatus 100 includes various functional units of the printing system 1000, except for the sheet processing apparatus 200. A number of sheet processing apparatuses connected to the printing apparatus 100 is not limited to only one. In FIG. 2, the printing system 1000 is configured to cause the sheet processing apparatus 200 connected to the printing apparatus 100 to execute sheet processing on the sheets printed by the printing apparatus 100. However, the sheet processing apparatus 200 may be omitted if only the printing apparatus 100 can constitute the printing system 1000. The sheet processing apparatus 200 can communicate with the printing apparatus 100. As described below, the sheet processing apparatus 200 can execute sheet processing (i.e., sheet post-processing) in response to an instruction received from the printing apparatus 100.

In the printing apparatus 100, a scanner unit 201 can read an image of a document and converts the read image into image data. The scanner unit 201 can transfer the image data to other unit. An external interface (I/F) 202 can transmit and receive data to and from another apparatus connected to the network 101. A printer (i.e., a printing unit) 203 can print an image on a sheet based on input image data.

As described below, an operation unit 204 includes a touch panel unit (i.e., a display unit) 401 and a key input unit 402 (see FIG. 4), via which users can input instructions. The operation unit 204 can perform various displays on its touch panel unit. The control unit 205 includes a central processing unit (CPU) 205*a* that can entirely control various processing and operations that can be performed by the functional units of the printing system 1000. Namely, the control unit 205 controls not only operations of the printing apparatus 100 but also operations of the sheet processing apparatus 200 connected to the printing apparatus 100.

A read only memory (ROM) 207 can store various computer programs that may be executed by the CPU 205*a*. For example, the ROM 207 can store a program that enables the control unit 205 to perform various processing illustrated in below-described flowcharts and a display control program required to display various setting screens as described below. The ROM 207 can further store a program that enables the control unit 205 to interpret page description language (PDL) coded data that may be received from the server PC 103 or the client PC 104 and rasterize the PDL coded data into raster image data. Additionally, the ROM 207 may store a boot sequence and font information.

A random access memory (RAM) 208 can store image data that may be received from the scanner unit 201 or the external I/F 202 as well as various programs and setting information that can be loaded from the ROM 207. The RAM 208 can further store information relating to the sheet processing apparatus 200 (e.g., total number of sheet processing apparatuses 200 connected to the printing apparatus 100, information relating to functions to be realized by each sheet processing apparatus 200, and a connection order of the sheet processing apparatuses 200). Writing and reading data into and from the RAM 208 can be executed under the control of the CPU 205*a*.

A hard disk drive (HDD) 209 includes a hard disk and a driving unit configured to perform reading/writing of data from/to the hard disk. The HDD 209 is a large-capacity storage apparatus capable of storing image data that may be received from the scanner unit 201 or the external I/F 202 and compressed by a compression/expansion unit 210. The HDD 209 can further store memory setting values (i.e., recommendable setting values) of below-described items.

The control unit 205 can cause the printer 203 to print image data stored in the HDD 209 based on an instruction input by a user. The control unit 205 can further transmit the image data stored in the HDD 209 to an external apparatus (e.g., the server PC 103) via the external I/F 202 based on an instruction input by the user.

The compression/expansion unit 210 can perform Joint Bi-level Image Experts Group (JBIG) compression/expansion processing and Joint Photographic Experts Group (JPEG) compression/expansion processing on the image data stored in the RAM 208 and the HDD 209.

Figure 3:
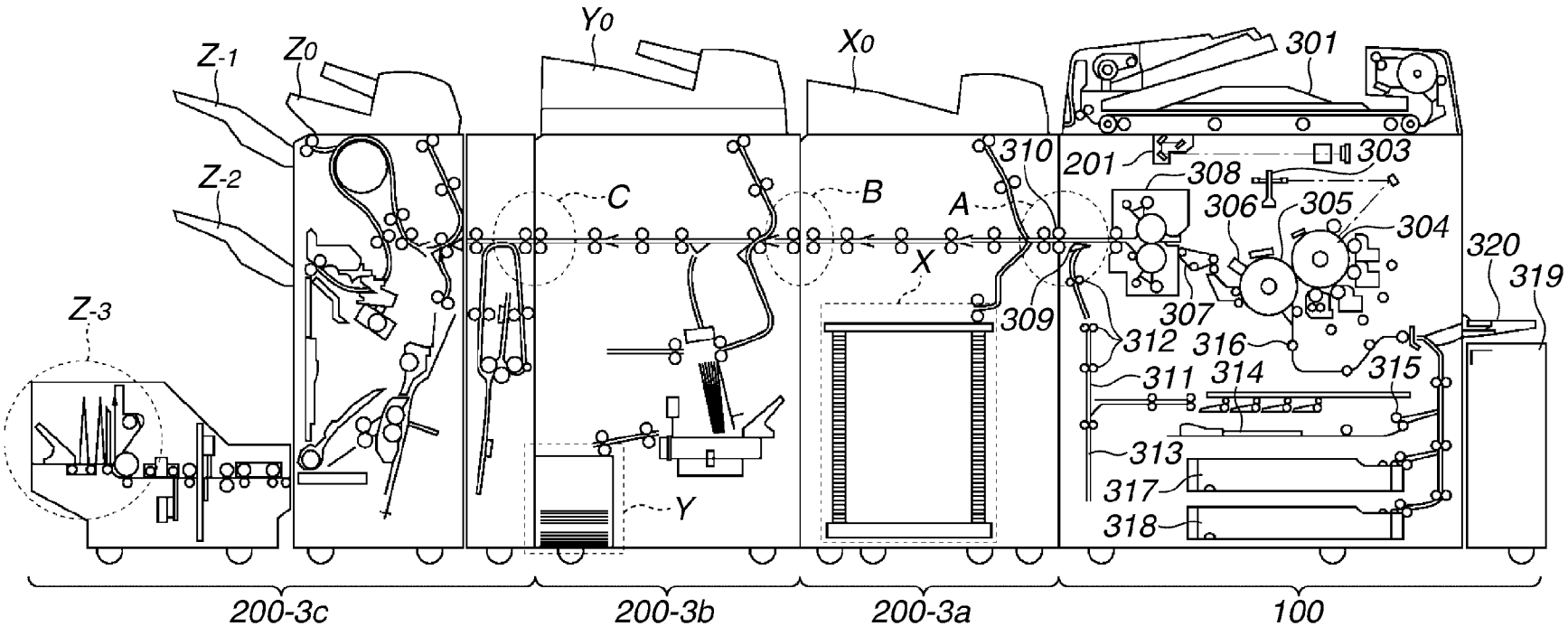
FIG. 3 illustrates a configuration of the printing system illustrated in FIG. 1.

FIG. 3 illustrates a configuration of the printing system 1000 illustrated in FIG. 1. The printing apparatus 100 illustrated in FIG. 3 includes an automatic document feeder (ADF) 301 that can successively separate an uppermost sheet of a document bundle set on a loading surface of its document tray (i.e., from the first page according to the page order) and convey each separated sheet to a document positioning glass plate, to enable the scanner unit 201 to scan and read the document.

The scanner unit 201 can read an image of a conveyed document on the document positioning glass plate and can convert the read image into image data using a charge-coupled device (CCD). A rotating polygonal mirror (e.g., a polygon mirror) 303 can reflect a laser beam modulated according to image data. The scanning light reflected by the rotating polygonal mirror 303 can travel via a reflection mirror and reach a photosensitive drum 304.

A latent image, if it is formed in this manner on the photosensitive drum 304, can be developed with a toner and a toner image can be transferred onto a sheet placed around a transfer drum 305. If above-described sequential image forming processes are successively executed for yellow (Y), magenta (M), cyan (C), and black (K) toners, a full-color image can be transferred on the sheet.

A separation claw 306 can separate the sheet on which the full-color image is transferred from the transfer drum 305. A pre-fixing carrier 307 conveys the separated sheet to a fixing unit 308.

The fixing unit 308 is formed by combinations of rollers and belts. The fixing unit 308 includes a heat source (e.g., a halogen heater) that can apply heat and pressure on the sheet on which the toner image is transferred so as to heat and fix the toner.

A discharge flapper 309 which is swingable about its swing axis can regulate a conveyance direction of each sheet. When the discharge flapper 309 rotates in the clockwise direction on FIG. 3, a sheet can be conveyed straight and discharged outside via discharge rollers 310. Through the above-described sequence, the control unit 205 can control the printing apparatus 100 so as to execute one-sided printing.

On the other hand, when image formation is performed on both surfaces of a sheet, the discharge flapper 309 rotates in the counterclockwise direction on FIG. 3 to change a sheet conveyance path downward that can guide the sheet to a two-sided conveyance unit. The two-sided conveyance unit includes a reversing flapper 311, reversing rollers 312, a reversing guide 313, and a two-sided tray 314. The reversing flapper 311 which is rotatable about its rotational axis can regulate the conveyance direction of the sheet.

The control unit 205, when it processes a two-sided print job, causes the printer 203 to perform printing on a first surface of a sheet and then convey the sheet to the reversing guide 313 via the reversing rollers 312. Then, the control unit 205 causes the reversing rollers 312 to temporarily stop rotating when a rear edge of the sheet is sandwiched between the reversing rollers 312 and then causes the reversing flapper 311 to rotate in the clockwise direction and further causes the reversing rollers 312 to rotate in the opposite direction. In this manner, the control unit 205 causes the sheet to make a switch back motion when it is conveyed and guides the sheet to the two-sided tray 314 in a state where the front and rear edges of the sheet are switched.

The sheet is temporarily stored in the two-sided tray 314 and then a re-feeding roller pair 315 conveys the sheet to a registration roller 316. In this case, the sheet is conveyed with a second surface (i.e., a surface different from the first surface in the first transfer process) in a facing relationship with the photosensitive drum 304. Then, similar to the above-described processing, an image of the next page is transferred to the second surface of the sheet. The sheet which has been subjected to the two-sided image formation is then processed in the fixing unit 308 and discharged via the discharge rollers 310 to the outside of the printing apparatus 100.

The control unit 205 controls the printing apparatus 100 to execute two-sided print processing according to the above-described sequence.

The printing apparatus 100 includes a sheet feeding unit that can store sheets that may be used in print processing. The sheet feeding unit includes sheet feeding cassettes 317 and 318 (e.g., each having a storage capacity of 500 sheets), a sheet feeding deck 319 (e.g., having a storage capacity of 5000 sheets), and a manual feeding tray 320. The sheet feeding cassettes 317 and 318, and the sheet feeding deck 319 can store various types of sheets including tabloid sheets used in the present exemplary embodiment which may be different in size and material and special sheet like a feeding sheet.

Each of the sheet feeding cassettes 317 and 318, the sheet feeding deck 319, and the manual feeding tray 320 is equipped with a feeding roller that can rotate to successively feed the sheets.

The sheet processing apparatus 200 illustrated in FIG. 3 is described below in more detail. An arbitrary type and an arbitrary amount of apparatuses can be connected as the sheet processing apparatus 200 to the printing system 1000 according to the present exemplary embodiment as long as the apparatuses can convey sheets from an upstream apparatus to a downstream apparatus via a sheet conveyance path. For example, as illustrated in FIG. 3, a large capacity stacker 200-3*a*, a gluing bookbinding machine 200-3*b*, and a saddle stitch binding machine 200-3*c* are sequentially connected to the printing apparatus 100 in this order on the downstream side of the printing apparatus 100. The large capacity stacker 200-3*a*, the gluing bookbinding machine 200-3*b*, and the saddle stitch binding machine 200-3*c* can be selectively used in the printing system 1000. Each of the sheet processing apparatus 200 includes a sheet discharge portion, so that a user can take out the processed sheets therefrom.

The control unit 205 receives an execution request of sheet processing, together with a print execution request, which can be requested by a user via the operation unit 204 among sheet processing candidates that can be executed by the sheet processing apparatuses 200 connected to the printing apparatus 100. In this case, the control unit 205 displays a screen illustrated in FIG. 5 on the touch panel unit 401. Then, in response to reception of the print execution request of a target job that may be input by the user via the operation unit 204, the control unit 205 causes the printer 203 to execute print processing required for the job. Then, the control unit 205 causes the printing apparatus 100 to convey the printed sheets of the job via the sheet conveyance path to the sheet processing apparatus that can execute sheet processing that the user requests. The sheet processing apparatus executes designated sheet processing.

For example, the printing system 1000 which has the system configuration illustrated in FIG. 3 may receive a print execution request from a user to process a job that requires massive stacking processing to be executed by the large capacity stacker 200-3*a*. This job can be referred to as a "stacker job." When the printing system illustrated in FIG. 3 processes the stacker job, the control unit 205 controls the printing apparatus 100 to convey the printed sheets of the job into the large capacity stacker 200-3*a* via a point A of FIG. 3. Then, the control unit 205 causes the large capacity stacker 200-3*a* to execute the stacking processing of the job as designated. The control unit 205 causes the large capacity stacker 200-3*a* to store a print product of the job which has been subjected to the stacking processing by the large capacity stacker 200-3*a* at its discharge destination X without conveying the print product to other apparatus (e.g., a post-stage apparatus).

The user can directly take the print product stored on the discharge destination X illustrated in FIG. 3 out of the large capacity stacker 200-3*a*. In other words, the user is not required to wait until the sheets reach a discharge destination (one of Z-1, Z-2, and Z-3) located at the most downstream side of the sheet conveyance path illustrated in FIG. 3 and to take the print product out of one of the discharge destination of the downstream end processing apparatus 200. In the present exemplary embodiment, if a user presses a button 519 on the display screen illustrated in FIG. 5 to instruct massive stacking processing, the control unit 205 controls a print job to be processed as a stacker job.

For example, the printing system 1000 which has the system configuration illustrated in FIG. 3 may receive a print execution request from a user to process a job that requires sheet processing (e.g., gluing bookbinding processing of case binding processing or pad binding processing) to be executed by the gluing bookbinding machine 200-3*b*. This job can be referred to as a "gluing bookbinding job." When the system illustrated in FIG. 3 processes the gluing bookbinding job, the control unit 205 controls the printing apparatus 100 to convey the printed sheets into the gluing bookbinding machine 200-3*b* via points A and B illustrated FIG. 3. Then, the control unit 205 causes the gluing bookbinding machine 200-3*b* to execute gluing bookbinding processing of the job as designated.

The control unit 205 causes the gluing bookbinding machine 200-3*b* to store a print product which has been subjected to the gluing bookbinding processing at its discharge destination Y without conveying the print product to other apparatus (e.g., a post-stage apparatus). When the case binding processing is performed, a front cover printed beforehand may be used. In this case, a sheet to be used as the front cover can be set on a tray Yo. In the present exemplary embodiment, if a user presses a button 517 or 518 on the display screen illustrated in FIG. 5 to instruct gluing bookbinding processing, the control unit 205 controls a print job to be processed as a gluing bookbinding job.

The printing system 1000 which has the system configuration illustrated in FIG. 3 may receive a print execution request from a user to process a job that requires sheet processing to be executed by the saddle stitch binding machine 200-3*c*. For example, the sheet processing to be executed by the saddle stitch binding machine 200-3*c* includes saddle stitch binding, punching processing, cutting processing, shift discharge processing, and folding processing. This job can be referred to as a "saddle stitch binding job." When the system illustrated in FIG. 3 processes the saddle stitch binding job, the control unit 205 controls the printing apparatus 100 to convey the printed sheets to the saddle stitch binding machine 200-3*c* via the points A, B, and C. Then, the control unit 205 causes the saddle stitch binding machine 200-3*c* to execute sheet processing of the job as designated. The control unit 205 causes the saddle stitch binding machine 200-3*c* to store a print product which has been subjected to the sheet processing at its discharge destination. The saddle stitch binding machine 200-3C has an inserter tray Zo from which a sheet printed beforehand can be supplied.

For example, a cover sheet printed beforehand can be set on the inserter tray Zo. The sheet supplied from the inserter tray Zo can be merged into the sheets output from the printing apparatus 100. The saddle stitch binding machine 200-3*c* can perform post-processing for binding these sheets into a single bundle. The saddle stitch binding machine 200-3*c* has a plurality of discharge destinations (i.e., Z-1, Z-2, and Z-3). These discharge destinations can be selectively used according to the type of each sheet processing that can be executed by the saddle stitch binding machine 200-3*c*. For example, the discharge destination Z-3 can serve as a holding portion for a booklet (i.e., a print product) when the apparatus performs saddle stitch binding processing. The discharge destination Z-2 can serve as a stack tray for the print product when the apparatus performs stapling processing, punching processing, or folding processing. The discharge destination Z-1 can serve as a sample tray for the print product when the print product is discharged without being subjected to the above-described sheet processing.

Figure 5:
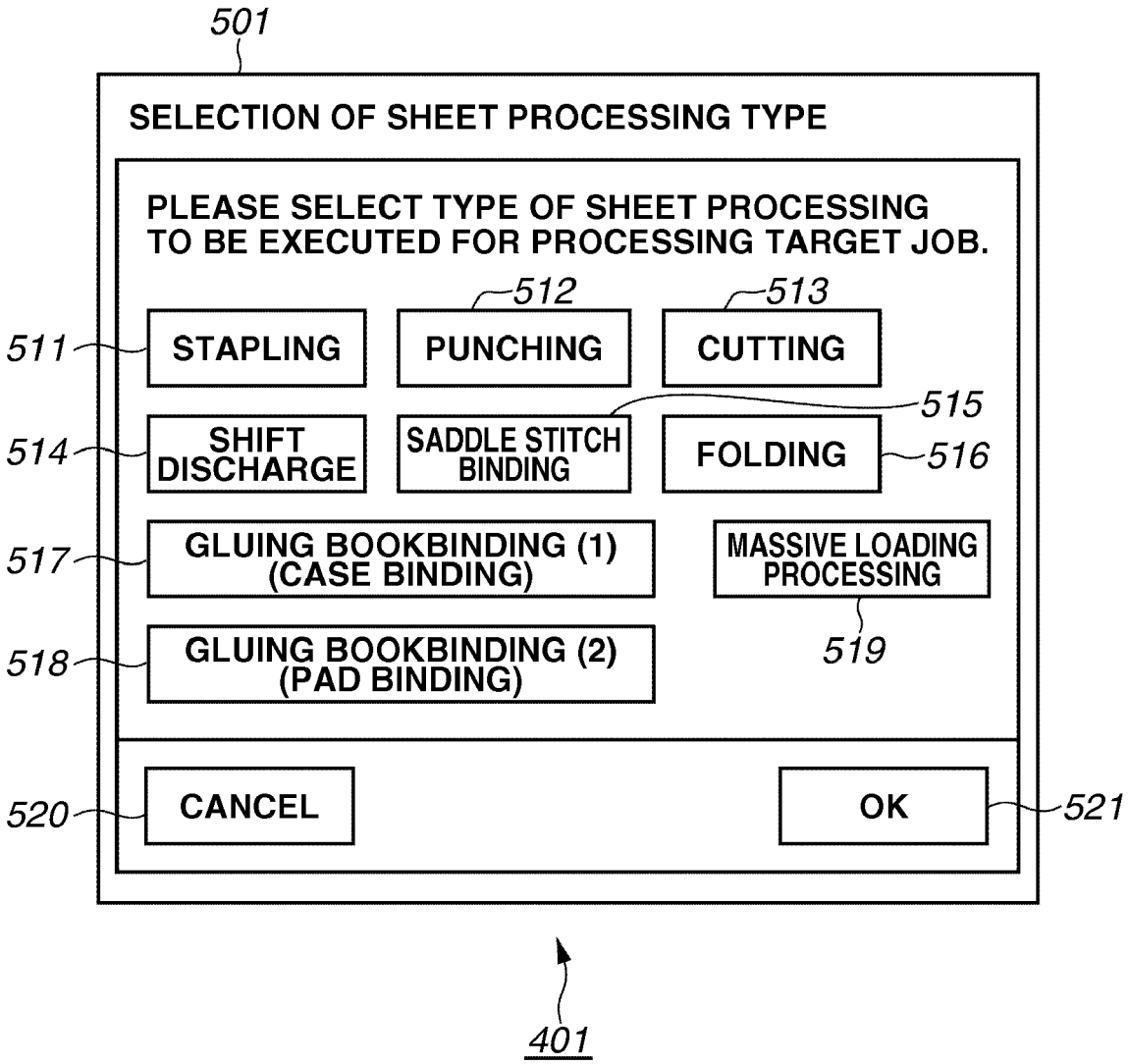
FIG. 5 illustrates an example display screen that may be displayed on a touch panel unit illustrated in FIG. 4.

In the present exemplary embodiment, if a user presses one of buttons 511, 512, 513, 514, 515, and 516 on the display screen illustrated in FIG. 5 to instruct sheet processing to be performed by the saddle stitch binding machine 200-3*c*, the control unit 205 controls a print job to be processed as a saddle stitch binding job. In the present exemplary embodiment, the large capacity stacker 200-3*a* has an escape tray Xo as an external discharge destination. The escape tray Xo can be used to discharge a sheet conveyed from the upstream apparatus if the sheet cannot be used as a final product. For example, if a preceding sheet sticks (e.g., when sheet jam occurs) during a conveyance operation, feeding of the following sheet may be already started at the time when a print interruption occurs. In such a case, the sheet remaining in the machine and a duplicatively supplied sheet can be removed from the escape tray Xo, without being conveyed to a downstream apparatus.

Figure 4:
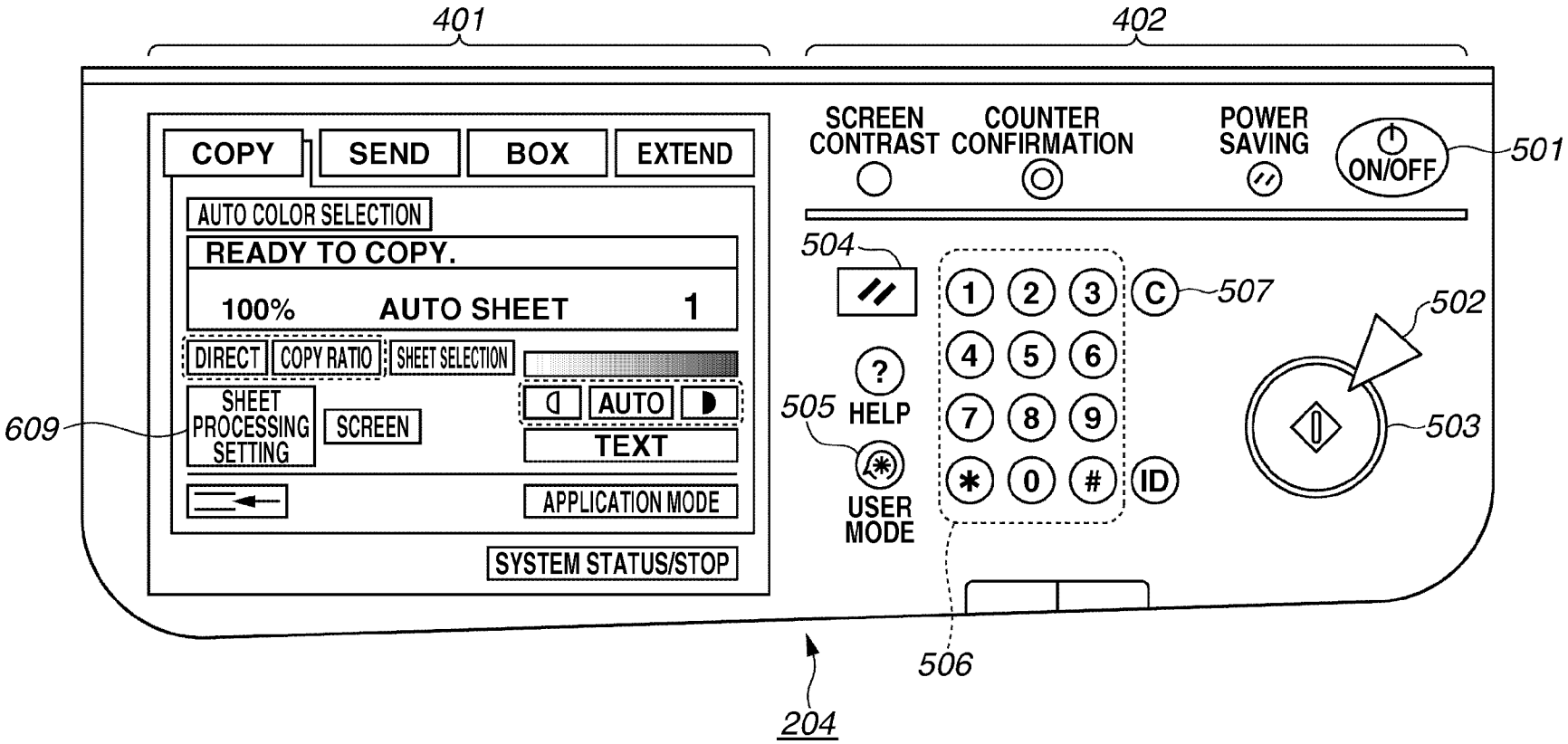
FIG. 4 illustrates an appearance of an operation unit illustrated in FIG. 2.

FIG. 4 illustrates an appearance of the operation unit 204 illustrated in FIG. 2. The operation unit 204 includes the touch panel unit (i.e., a display unit) 401 and the key input unit 402. The touch panel unit 401 includes a liquid crystal display and transparent electrodes provided thereon. The touch panel unit 401 can display various setting screens to enable users to input instructions. The touch panel unit 401 has a display function for displaying various screens and an input function for accepting instructions from users. The key input unit 402 includes a power key 501, a stop key 502, a start key 503, a guide key 504, a user mode key 505, a numeric keypad 506, and a clear key 507. The start key 503 enables users to instruct the printing apparatus 100 to start executing a copy job and a transmission job. The numeric keypad 506 enables users to input numerical values, such as the number of sets of copies.

The control unit 205 controls the printing system 1000 to perform various processing based on user's instructions accepted via various screens displayed by the touch panel unit 401 or based on user's instructions accepted via the key input unit 402. The touch panel unit 401 can display mode buttons that enable users to set various operation modes (e.g., copy, send, box, and extend modes) and various instruction buttons to be used to input print copy ratio and sheet settings (e.g., a sheet processing setting button 609). The above-described instruction buttons are conventionally known and their descriptions are omitted. An operation to be performed when the sheet processing setting button 609 is instructed (i.e., touched) is described below. The touch panel unit 401 of the operation unit 204 of the printing apparatus 100 can display the following setting screens. FIG. 5 illustrates a first example display screen that can be displayed on the touch panel unit 401 illustrated in FIG. 4. More specifically, if a user presses the sheet processing setting button 609, the touch panel unit 401 displays the display screen illustrated in FIG. 5.

The user can operate the buttons (i.e., soft keys) displayed on the display screen 510 to select the type of sheet processing to be executed by the sheet processing apparatus 200 that can be used by the printing system 1000. The button 511 enables users to instruct stapling processing. The button 512 enables users to instruct punching processing. The button 513 enables users to instruct cutting processing. The button 514 enables users to instruct shift discharge processing. The button 515 enables users to instruct saddle stitch binding processing. The button 516 enables users to instruct folding processing. The button 517 enables users to instruct gluing bookbinding (1) (case binding). The button 518 enables users to instruct gluing bookbinding (2) (pad binding). The button 519 enables users to instruct massive stacking processing. A cancel button 520 enables users to cancel all of the settings. An OK button 521 enables the settings.

Figure 6A:
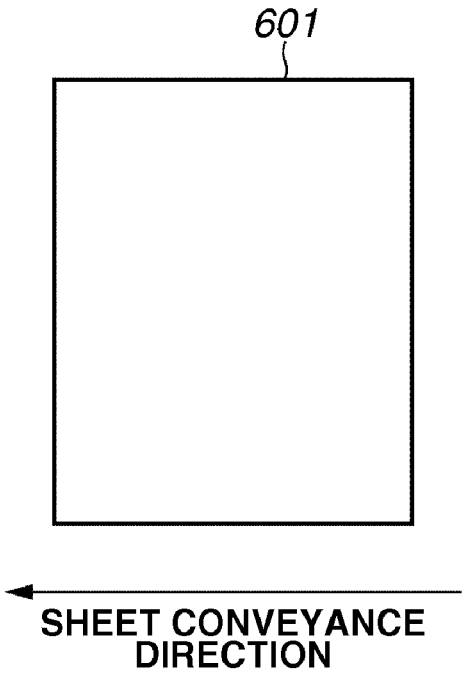
FIGS. 6A and 6B illustrate sheet conveyance directions (i.e., sheet feeding directions) corresponding to the long edge feed and the short edge feed, respectively.
Figure 6B:
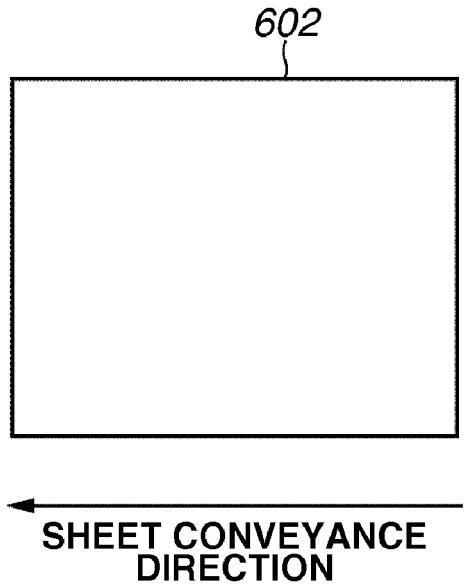

FIGS. 6A and 6B illustrate a sheet conveyance direction (i.e., a sheet feeding direction) corresponding to the long edge feed mode and the short edge feed mode, respectively. The print mode corresponding to the long edge feed can be referred to as a long edge feed mode. The print mode corresponding to the short edge feed can be referred to as a short edge feed mode. As illustrated in FIG. 6A, the printing apparatus 100 according to the present exemplary embodiment can perform printing on sheets if they are supplied by the long edge feed mode from the sheet feeding unit (317, 318, 319, and 320). As illustrated in FIG. 6B, the printing apparatus 100 according to the present exemplary embodiment can further perform printing on sheets if they are supplied from the sheet feeding unit by the short edge feed mode. The control unit 205 controls the printing apparatus 100 to selectively perform print processing according to the above-described two types of print modes.

The printing apparatus 100 according to the present exemplary embodiment can perform settings for improving the performances when a user presses the user mode key 505 of the operation unit 204, as described below.

Figure 7:
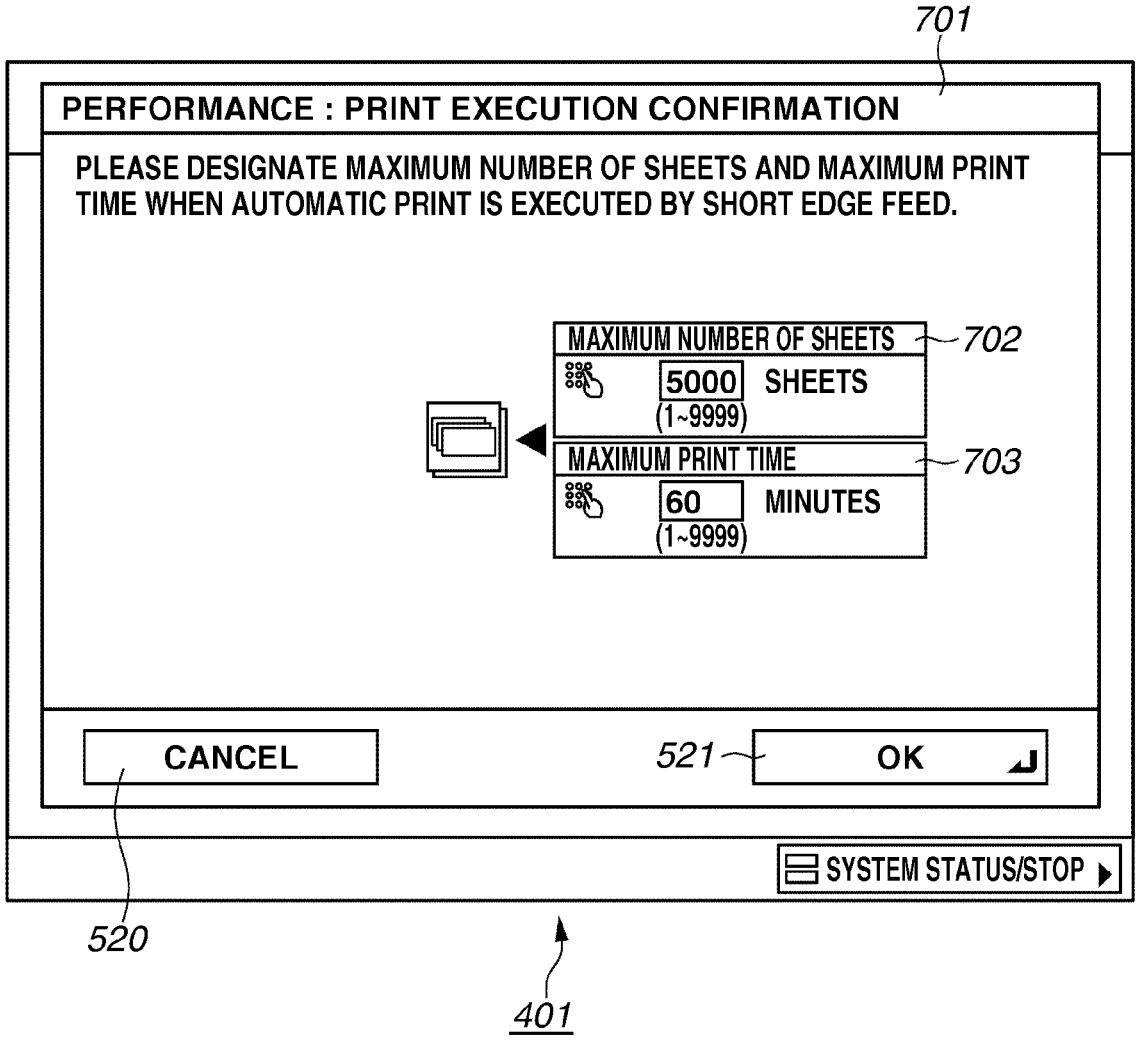
FIG. 7 illustrates an example display screen that can be displayed on the touch panel unit illustrated in FIG. 4.

FIG. 7 illustrates a second example display screen that can be displayed on the touch panel unit 401 illustrated in FIG. 4. If a user presses the user mode key 505 of the operation unit 204, the touch panel unit 401 displays a display screen 701 illustrated in FIG. 7.

For example, if a user wants the control unit 205 to determine a print mode (see step S1104 of FIG. 11) when the total number of sheets to be printed is equal to or greater than 5000, the user can operate the numeric keypad 506 to input "5000" in a display area 702 and then press the OK button 521 to complete the settings. The set data can be stored in the RAM 208 and can be referred to, if necessary, before the print processing is completed.

Next, a method for using a value set in the display area 702 is described below. If a print job is input to the printing apparatus 100, the control unit 205 counts the total number of pages. After completing the page counting operation, the control unit 205 performs processing for specifying the number of sheets to be required to output the print job. For example, if the total number of pages is 8000 and a print job includes an instruction for performing one-sided printing to realize a 2-UP imposition, the number of sheets required to output the print job is 4000 (=8000÷2). If the print job includes an instruction for performing two-sided printing to realize the 2-UP imposition, the number of sheets required to output the print job is 2000 (=8000÷4). The control unit 205 compares the value set in the display area 702 with the number of sheets required to output the print job.

Further, maximum print time can be set as another example setting for improving the performances, as described below. First, if a user presses the user mode key 505 of the operation unit 204, the touch panel unit 401 displays the display screen 701 illustrated in FIG. 7. For example, if a user wants the control unit 205 to determine a print mode (see step S1104) when time required to complete a print job input in the printing apparatus 100 is equal to or greater than 60 minutes, the user can operate the numeric keypad 506 to input "60" in a display area 703. Then, the user can press the OK button 521 to complete the settings.

Next, a method for using a value set in the display area 703 is described below. If a print job is input to the printing apparatus 100, the control unit 205 counts the total number of pages. After completing the page counting operation, the control unit 205 performs processing for specifying print time to be required to output the print job.

For example, if the user wants the control unit 205 to determine a print mode (see step S1104) when the print time is 60 minutes, the user can operate the numeric keypad 506 to input "60" in the display area 703 and press the OK button 521 to complete the settings. Then, the control unit 205 calculates the number of sheets that can be conveyed within the time set by the printing apparatus 100 if the short edge feed printing is performed. For example, if the value designated in the display area 703 is 60 minutes and the time required to convey a sheet by the short edge feed is 0.5 seconds, the number of sheets that can be conveyed is 7200 (=60×60÷0.5). The control unit 205 compares this value with the number of sheets required to output the print job input in the printing apparatus 100, and determines the print mode as illustrated in step S1104.

Figure 8:
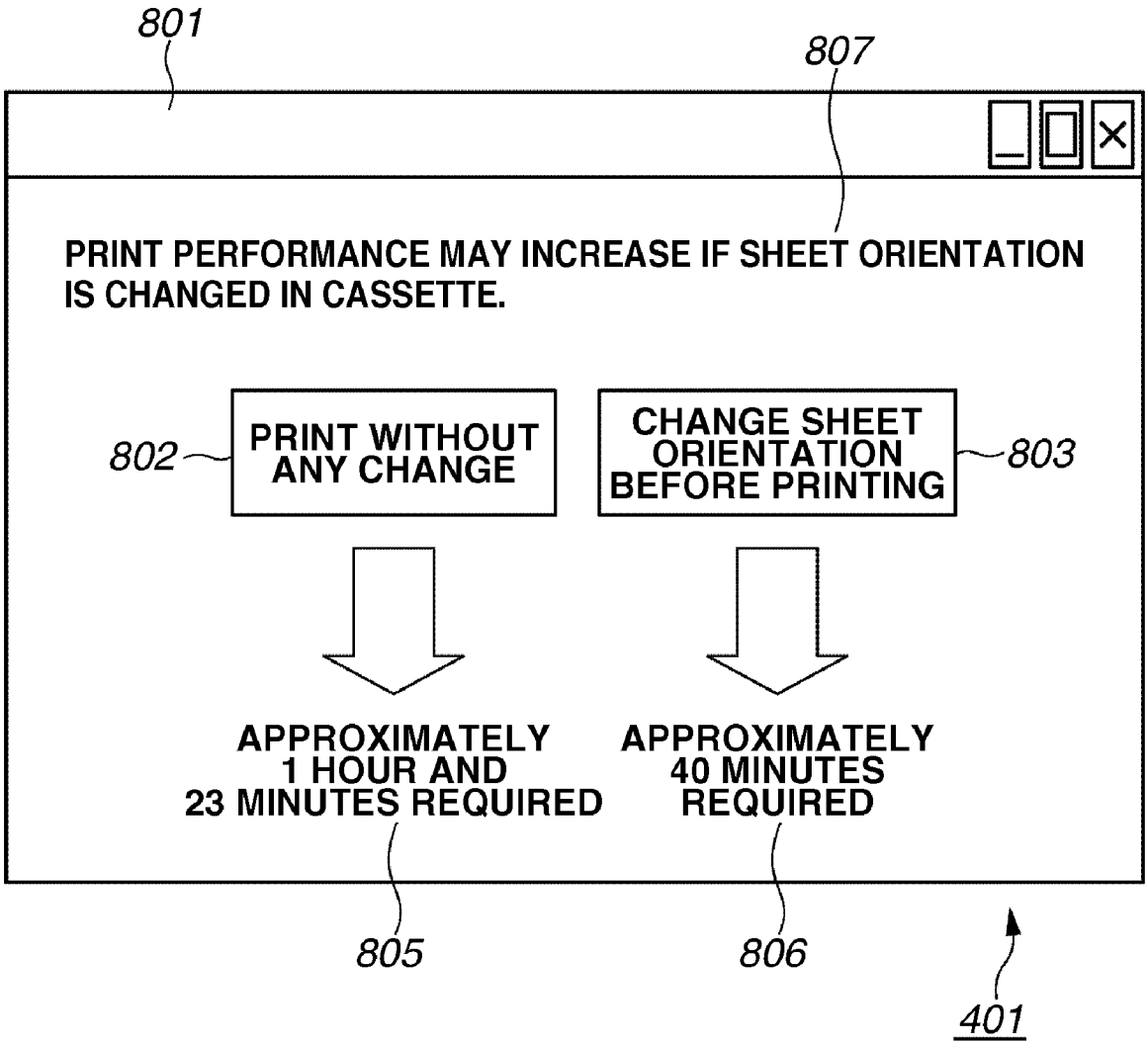
FIG. 8 illustrates an example display screen that can be displayed on the touch panel unit illustrated in FIG. 4.

FIG. 8 illustrates a third example display screen that can be displayed on the touch panel unit 401 illustrated in FIG. 4. More specifically, the display screen illustrated in FIG. 8 can be displayed when the control unit 205 determines in step S1104 that the number of sheets required for an input print job is equal to or greater than a predetermine number designated by the user and the sheets required to execute print processing can be conveyed only by the short edge feed.

For example, it is assumed that the value set in the display area 702 of FIG. 7 is "6000" and the number of sheets to be used for the print job input in the printing apparatus 100 is 8000. In this case, if the sheets stored in the sheet feeding unit (i.e., the sheet feeding cassettes 317 and 318, the sheet feeding deck 319, and the manual feeding tray 320) are set to be conveyed by the short edge feed, the control unit 205 causes the touch panel unit 401 to display a display screen 801.

The control unit 205 calculates printing time required if a printing operation is performed using the sheets that are set in the sheet feeding unit to be supplied by the short edge feed, based on the number of sheets to be required to output the print job and the time required to convey a single sheet. Then, the control unit 205 causes the touch panel unit 401 to display the calculated printing time in a display area 805. The control unit 205 further calculates printing time required if the printing operation is performed using the sheets whose orientation in the sheet feeding unit is changed to be supplied by the long edge feed, based on the number of sheets to be required to output the print job and the time required to convey a single sheet. Then, the control unit 205 causes the touch panel unit 401 to display the calculated printing time in a display area 806.

Information displayed in the display area 805 is first display information that enables users to confirm first requisite time that is required to complete the print processing according to a first print mode when the number of sheets to be used for a print job is equal to or greater than a predetermined value. On the other hand, information displayed in the display area 806 is second display information that enables users to confirm second requisite time that is required to complete the print processing according to a second print mode when the number of sheets to be used for the print job is equal to or greater than the predetermined value. Further, information displayed in a display area 807 is third display information that enables users to confirm that the second requisite time is shorter than the first requisite time when the number of sheets to be used for the print job is equal to or greater than the predetermined value.

Figure 9:
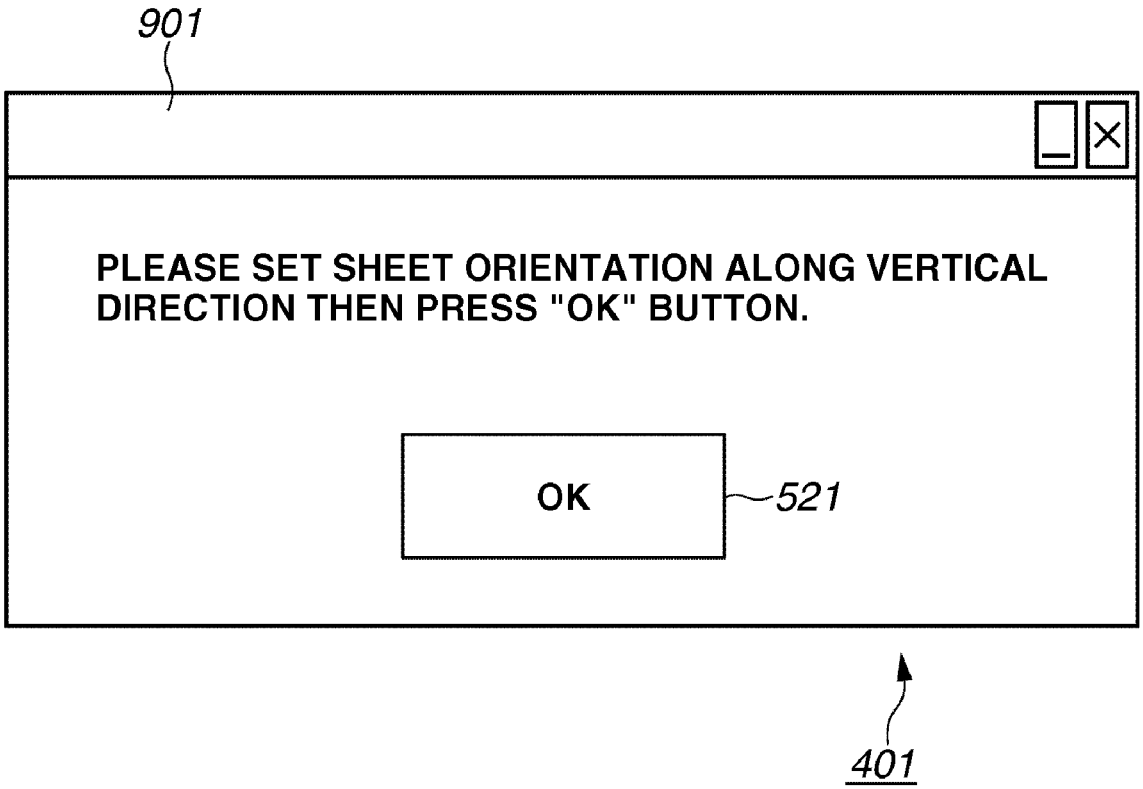
FIG. 9 illustrates an example display screen that can be displayed on the touch panel unit illustrated in FIG. 4.

FIG. 9 illustrates a fourth example display screen that can be displayed on the touch panel unit 401 illustrated in FIG. 4. If a user presses a "CHANGE SHEET ORIENTATION BEFORE PRINTING" button 803 displayed on the display screen 801 as illustrated in FIG. 8 to change the orientation of the sheet before printing, the control unit 205 causes the touch panel unit 401 to display a display screen 901 illustrated in FIG. 9. When the touch panel unit 401 displays the display screen 901, the user changes the orientation of sheets set in the sheet feeding unit (317, 318, 319, and 320) of the printing apparatus 100 so that the sheets can be supplied by the long edge feed. After the orientation of the sheets is changed, the user can press the OK button 521 to start printing.

Figure 10:
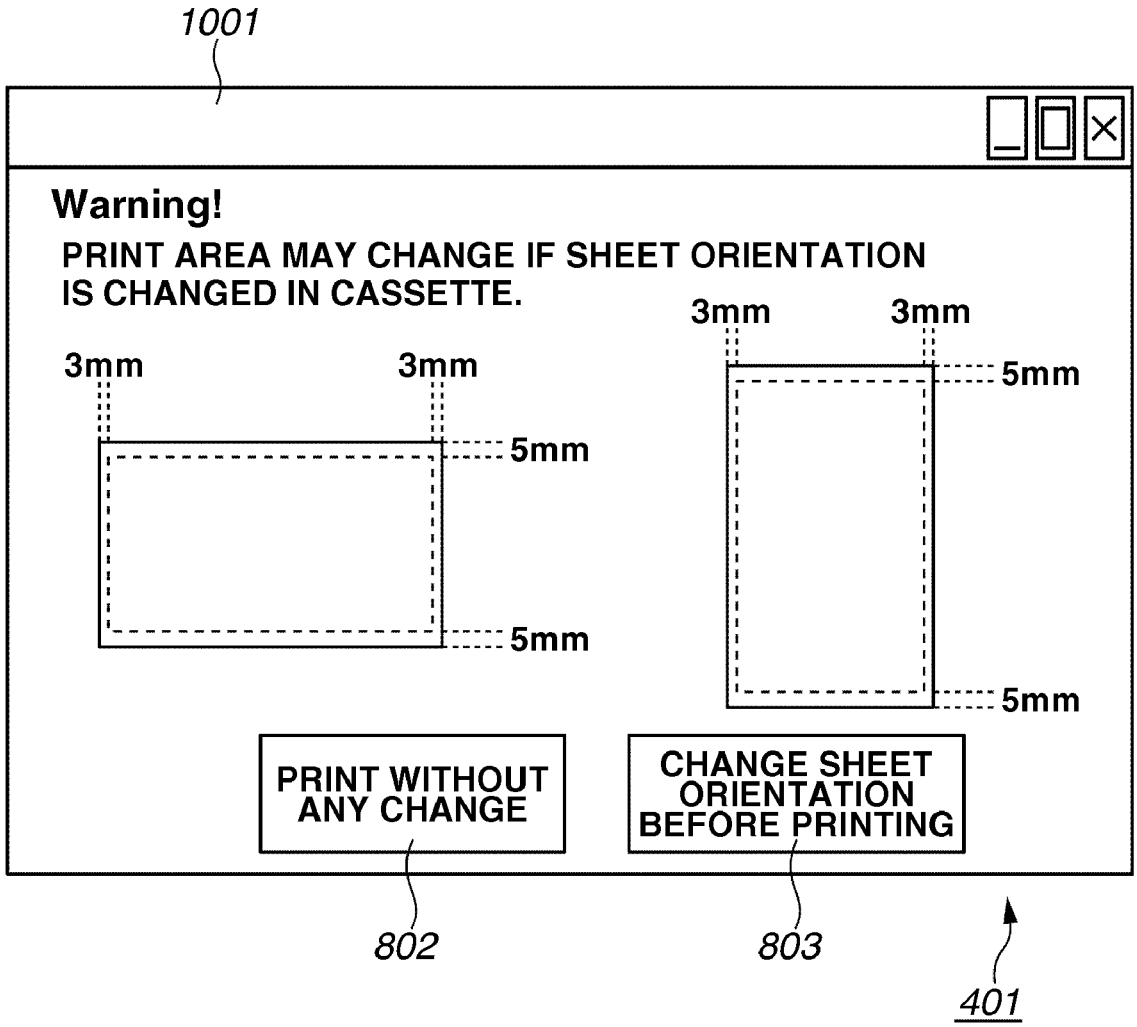
FIG. 10 illustrates an example display screen that can be displayed on the touch panel unit illustrated in FIG. 4.

FIG. 10 illustrates a fifth example display screen that can be displayed on the touch panel unit 401 illustrated in FIG. 4. More specifically, the display screen illustrated in FIG. 10 can be displayed when the control unit 205 determines to perform printing in the second print mode in step S1402 of FIG. 14.

If the sheet feeding direction is changed, margins set for a main scanning direction and margins set for a sub scanning direction are switched. If the printing apparatus sets different margins in the main scanning direction and the sub scanning direction, a printing area may change from the original printing area due to the above-described sheet orientation change. Therefore, a display screen 1001 illustrated in FIG. 10 notifies the user of a difference in the printing area and enables the user to determine whether to execute printing after changing the feed direction or execute printing without changing the feed direction.

Processing performed by the printing apparatus 100 according to the present exemplary embodiment is described below with reference to FIGS. 11 to 15.

Figure 11:
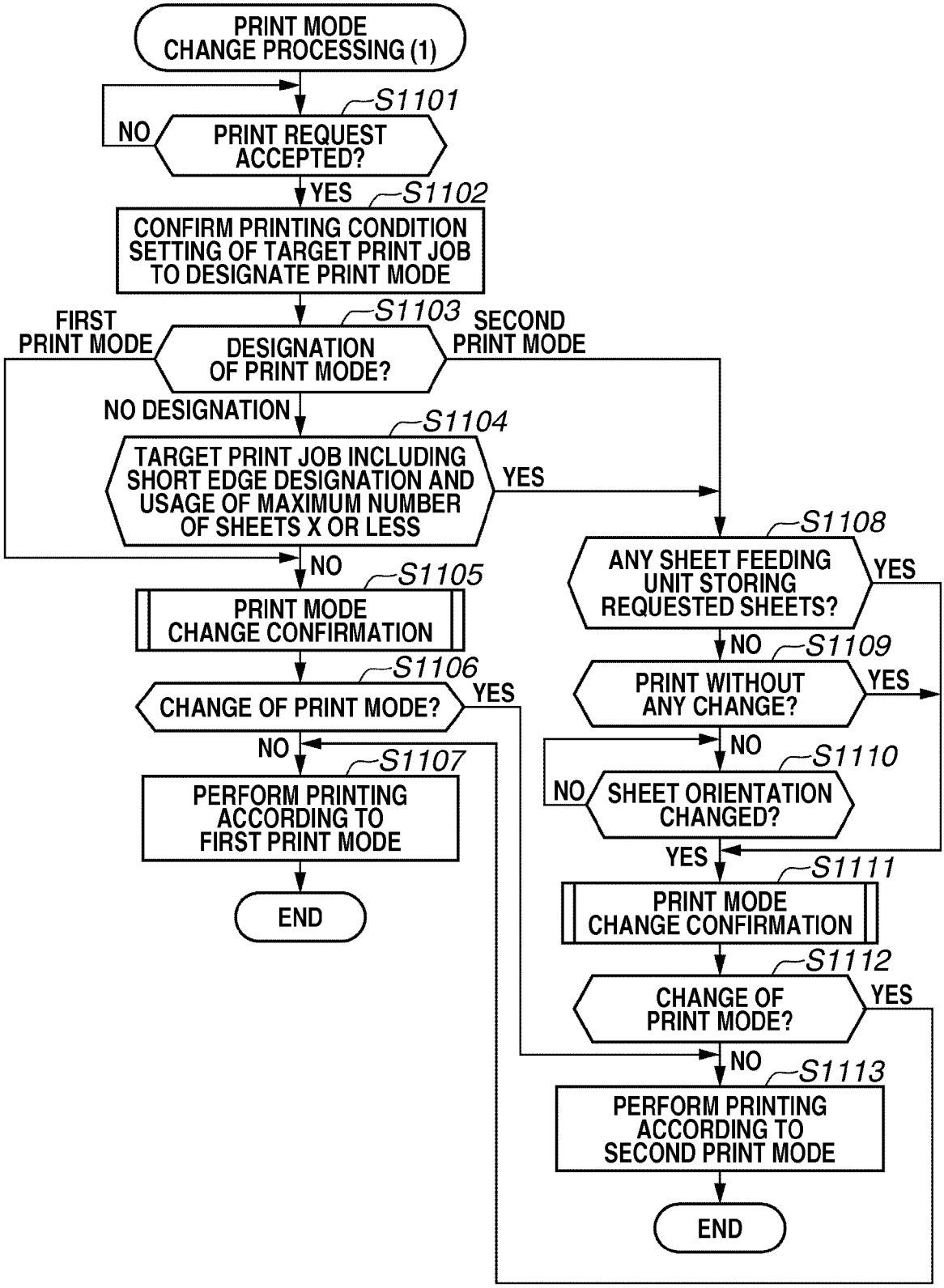
FIG. 11 is a flowchart illustrating a procedure of print mode change processing according to the present exemplary embodiment which can be executed by the printing apparatus illustrated in FIG. 2.

FIG. 11 is a flowchart illustrating a procedure of print mode change processing executed by the printing apparatus 100 illustrated in FIG. 2 according to a first exemplary embodiment. A program for executing the print mode change processing may be stored in the ROM 207 and can be executed under the control of the CPU 205*a* of the control unit 205.

In FIG. 11, if it is determined that a print request is accepted, the control unit 205 stores print request data in the RAM 208 and calculates the number of sheets required to perform printing. Then, the control unit 205 advances processing to step S1102.

In step S1102, the control unit 205 determines whether the target print job requires conveying a sheet in a specific direction. The control unit 205 collates print conditions set for the target print job with print conditions stored beforehand in the RAM 208 for determining a print mode. If the print conditions set for the target print job accord with the print conditions stored beforehand for determining the print mode, the control unit 205 performs control for conveying sheets in a direction set by the print conditions.

Figure 12:
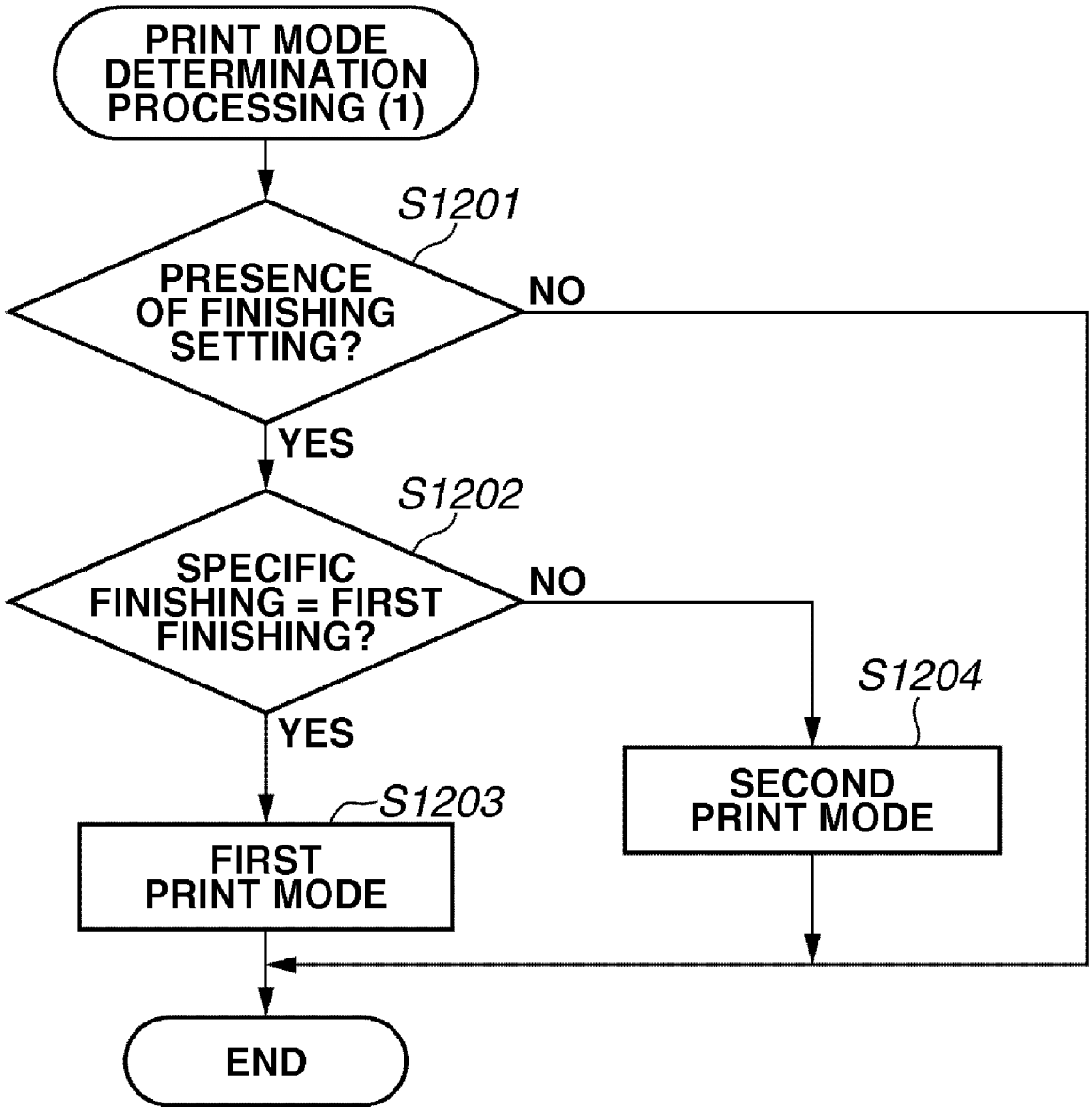
FIG. 12 is a flowchart illustrating a procedure of print mode determination processing which can be executed in step S1102 of FIG. 11.

Example processing is described below in detail. FIG. 12 is a flowchart illustrating a first example procedure of print mode determination processing which can be executed in step S1102 of FIG. 11. More specifically, FIG. 12 is a flowchart for performing a procedure in step S1102 for determining the print mode based on a specific finishing setting included in a print job. For example, when the print job includes a finishing setting for the case binding, the saddle stitch binding, or the stapling, the sheets are to be conveyed by the short edge feed. When the print job includes a finishing setting for the punching, the sheets are to be conveyed by the long edge feed.

After the control unit 205 advances processing to step S1102 of FIG. 11, the control unit 205 advances processing to step S1201 of FIG. 12. The control unit 205 performs collation whether the print conditions of the target print job stored in the RAM 208 include a finishing setting.

In the collation work, if it is determined that the target print job does not include any finishing setting (NO in step S1201), the control unit 205 terminates the processing of the routine illustrated in FIG. 12. If it is determined that the target print job includes a finishing setting (YES in step S1201), the control unit 205 advances processing to step S1202. In step S1202, the control unit 205 determines whether the finishing setting is the first print mode.

If in step S1202 it is determined that the target print job includes the finishing setting for the case binding, the saddle stitch binding, or the stapling to be executed according to the first print mode (the short edge feed mode) (YES in step S1202), the control unit 205 advances processing to step S1203. In step S1203, the control unit 205 changes the settings of print job data stored in the RAM 208 to print the target print job according to the first print mode (the short edge feed mode). If in step S1202 it is determined that the target print job includes the finishing setting for the punching to be executed according to the second print mode (the long edge feed mode) (NO in step S1202), the control unit 205 advances processing to step S1204. In step S1204, the control unit 205 changes the settings of the print job data stored in the RAM 208 to print the target print job according to the second print mode (the long edge feed mode).

Figure 13:
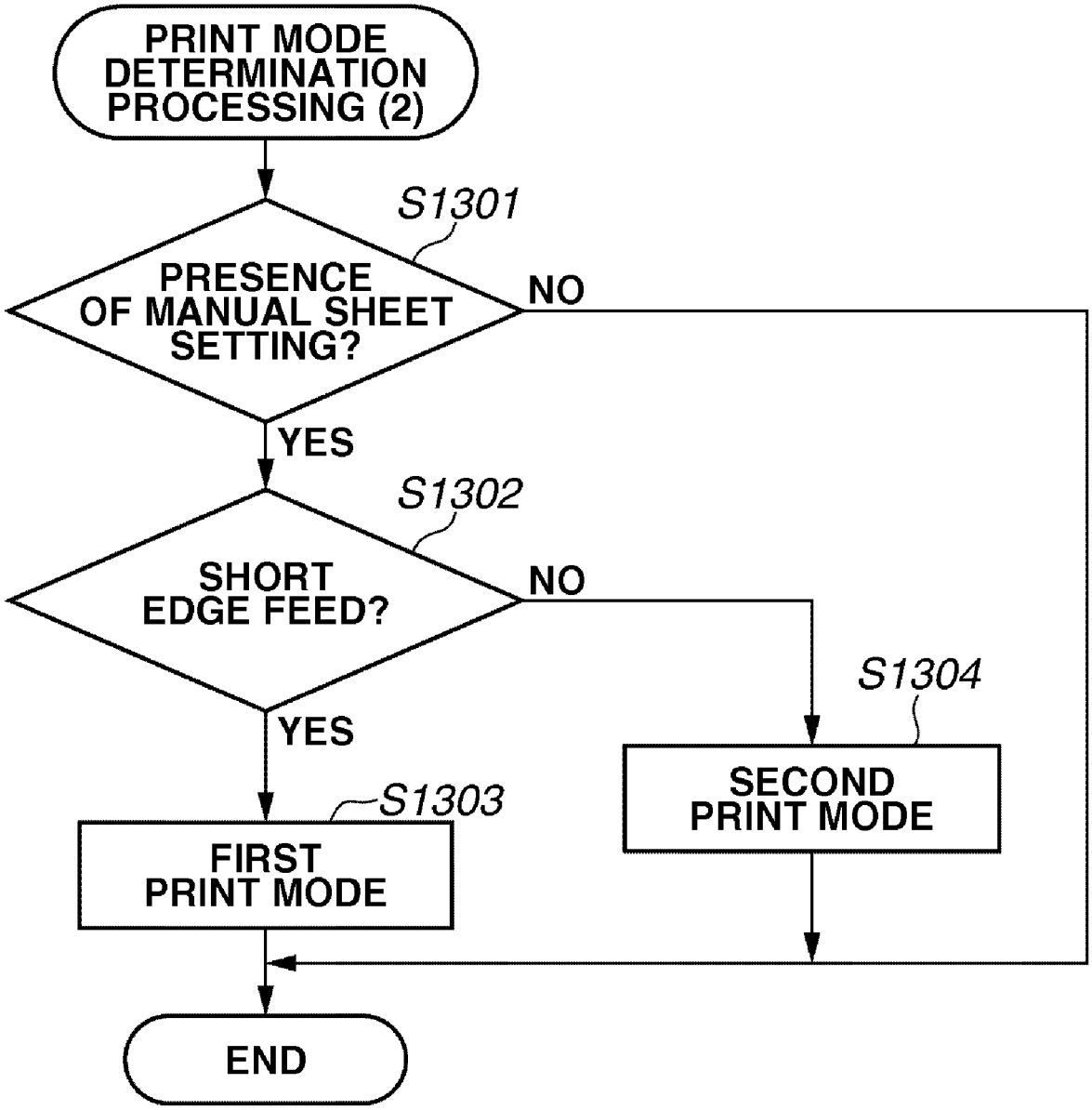
FIG. 13 is a flowchart illustrating a procedure of print mode determination processing which can be executed in step S1102 of FIG. 11.

FIG. 13 is a flowchart illustrating a second example procedure of the print mode determination processing which can be executed in step S1102 of FIG. 11. More specifically, FIG. 13 is a flowchart for performing a procedure in step S1102 for determining the print mode based on a manual sheet setting included in a print job.

In FIG. 13, in step S1301, the control unit 205 determines whether the target print job includes a manual sheet setting. If the control unit 205 determines that the target print job does not include the manual sheet setting (NO in step S1301), the control unit 205 terminates the processing of the routine illustrated in FIG. 13.

If the control unit 205 determines that the target print job includes the manual sheet setting (YES in step S1301), the control unit 205 advances processing to step S1302. In step S1302, the control unit 205 determines whether which of the first or second print mode the target print job includes in the sheet setting.

For example, if the target print job includes the sheet setting that designates A4R, the control unit 205 advances processing to step S1303. In step S1303, the control unit 205 performs settings of the print job data stored in the RAM 208 to print the target print job according to the first print mode (the short edge feed mode). If the target print job includes the sheet setting that designates A4 (No in step S1302), then the control unit 205 advances processing to step S1304. In step S1304, the control unit 205 changes the settings of the print job data stored in the RAM 208 to print the target print job according to the second print mode (the long edge feed mode).

Referring back to FIG. 11, after the control unit 205 completes the print mode determination processing in step S1102, the control unit 205 advances processing to step S1103.

In step S1103, the control unit 205 determines whether the determined print mode is the first print mode (the short edge feed mode) or the second print mode (the long edge feed mode), or not specially designated.

If in step S1103 it is determined that the target print job includes a designation of printing according to the first print mode (the short edge feed mode) (FIRST PRINT MODE in step S1103), the control unit 205 advances processing to step S1107.

If in step S1103 it is determined that the target print job includes the designation of printing according to the second print mode (the long edge feed mode) (SECOND PRINT MODE in step S1103), the control unit 205 advances processing to step S1113.

If in step S1103 it is determined that the target print job does not require printing either the first print mode (the short edge feed mode) or the second print mode (the long edge feed mode) (NO designation in step S1103), the control unit 205 advances processing to step S1104.

In step S1104, the control unit 205 compares the value set in the display area 702 of FIG. 7 (i.e., the value stored in the RAM 208 as the maximum number of sheets to be printed) with the number of sheets to output the print job which was calculated by the control unit 205. Further, the control unit 205 accesses the RAM 208 and determines whether the target print job includes a designation of supplying the sheets by the short edge feed.

As a result of above-described two comparisons, if it is determined that the number of sheets to output the print job is less than the maximum number of sheets to be printed and the short edge feed is designated (NO in step S1104), the control unit 205 advances processing to step S1107. As a result of above-described two comparisons, if it is determined that the number of sheets to output the print job is equal to or greater than the maximum number of sheets to be printed and the short edge feed is designated (YES in step S1104), the control unit 205 advances processing to step S1108.

In step S1104, the control unit 205 may compare time to output the print job with the maximum print time set in the display area 703 illustrated in FIG. 7. For example, if the designated maximum print time is 60 minutes, then in step S1104, the control unit 205 calculates whether the print job can be completed within 60 minutes based on the number of sheets required for the print job stored in the RAM 208 and the time to print a sheet. If in step S1104 the control unit 205 determines that the print processing can be completed within 60 minutes (NO in step S1104), the control unit 205 advances processing to step S1107. If the control unit 205 determines that the print job cannot be completed within 60 minutes (YES in step S1104), the control unit 205 advances processing to step S1108.

In step S1107, the control unit 205 instructs the printer 203 to perform print processing according to the first print mode (the short edge feed mode). Then, the control unit 205 terminates the processing of the routine illustrated in FIG. 11.

If it is determined that the sheets used in the long edge feed mode are set in any of the sheet feeding units (YES in step S1108), the control unit 205 advances processing to step S1111.

If the control unit 205 determines that any of the sheet feeding units does not store the sheet used in the long edge feed mode (NO in step S1108), the control unit 205 advances processing to step S1109. In step S1109, the control unit 205 displays the display screen 801 illustrated in FIG. 8 on the touch panel unit 401. In this case, to display the areas 805 and 806, the control unit 205 calculates time required for discharging the sheets required to output the target print job based on the number of sheets and time required to convey a sheet.

For example, if the user presses the "PRINT WITHOUT ANY CHANGE (PRINT BY THE SHORT EDGE FEED MODE)" button 802, the control unit 205 advances processing to step S1107. If the user selects the "CHANGE SHEET ORIENTATION BEFORE PRINTING (PRINT BY THE RONG EDGE FEED MODE)" button 803, the control unit 205 displays the display screen 901 illustrated in FIG. 9 on the touch panel unit 401. When the display screen 901 is displayed, the user changes the orientation of sheets to be used for the printing so that the sheets can be supplied according to the long edge feed print mode. Then, the user presses the OK button 521.

After the OK button 521 is pressed by the user (NO in step S1109), the control unit 205 advances processing to step S1110. In step S1110, the control unit 205 waits until the user changes the orientation of the sheets. If the user has changed the orientation of the sheets, the control unit 205 advances processing to step S1111. In step S1111, the control unit 205 performs print mode change confirmation processing.

In step S1111, the control unit 205 confirms whether the print margins of the printing apparatus are different in each sheet feeding direction. If it is determined that the print margins of the printing apparatus are different in each sheet feeding direction, the control unit 205 checks if the user wants to perform printing even when the printing area may change. Then, the control unit 205 advances processing to step S1112.

Figure 14:
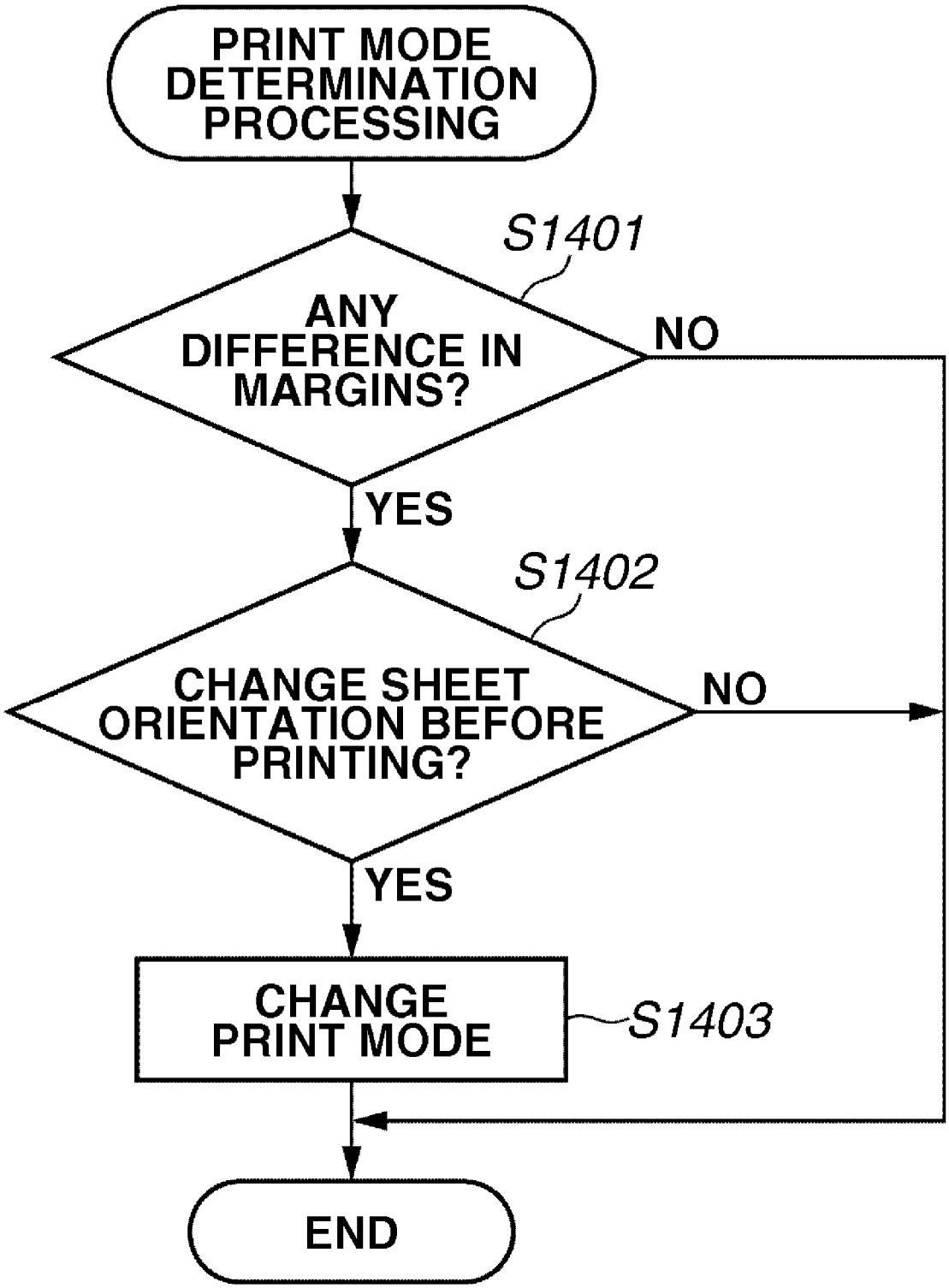
FIG. 14 is a flowchart illustrating a procedure of print mode change confirmation processing which can be executed in step S1111 of FIG. 11.

FIG. 14 is a flowchart illustrating a procedure of the print mode change confirmation processing which can be executed in step S1111 of FIG. 11. More specifically, the control unit 205 can execute the processing illustrated in FIG. 14 to determine the print mode by allowing a user to decide the print mode considering the differences in print margins in two sheet conveyance directions in the printing apparatus.

In step S1401 of FIG. 14, the control unit 205 accesses the ROM 207 and acquires margin values in each conveyance direction of the printing apparatus. If it is determined that the print margins according to the long edge feed and print margins according to the short edge feed are the same (NO in step S1401), the control unit 205 terminates the processing of the routine illustrated in FIG. 14.

If the control unit 205 determines that the print margins according to the long edge feed are different from the print margins according to the short edge feed (YES in step S1401), the control unit 205 advances processing to step S1402.

In step S1402, the control unit 205 displays the display screen 1001 illustrated in FIG. 10 on the touch panel unit 401 to notify the difference that may be caused in the printing area. If a "PRINT WITHOUT ANY CHANGE (PRINT BY THE SHORT EDGE FEED MODE)" button 802 is selected by the user (NO in step S1402), the control unit 205 terminates the processing of the routine illustrated in FIG. 14. If the "CHANGE SHEET ORIENTATION BEFORE PRINTING (PRINT BY THE LONG EDGE FEED MODE)" button 803 illustrated in FIG. 10 is selected (YES in step S1402), the control unit 205 advances processing to step S1403.

In step S1403, the control unit 205 changes the settings of the print job data stored in the RAM 208 to change the print mode of the target print job from the short edge feed mode to the long edge feed mode.

In step S1112, the control unit 205 accesses the RAM 208 and confirms whether the print mode has been changed. If it is determined that the print mode has not been changed (NO in step S1112), the control unit 205 advances processing to step S1107. In step S1107, the control unit 205 instructs the printer 203 to perform printing according to the first print mode (the short edge feed mode). Then, the control unit 205 terminates the processing of the routine illustrated in FIG. 11. If it is determined that the print mode has been changed (YES in step S112), the control unit 205 advances processing to step S1113, and instructs the printer 203 to perform printing according to the second print mode (the long edge feed mode) and terminates the processing of the routine illustrated in FIG. 11.

Next, as another exemplary embodiment of the present invention, processing performed when a stacker job that requires discharging a large amount of sheets to the large capacity stacker 200-3*a* is input is described below.

If a stacker job is input to the printing apparatus 100, the control unit 205 shifts the state of processing to step S1101 of FIG. 11 and stores print job data in the RAM 208. After the control unit 205 calculates the number of sheets to be required to output the print job, the control unit 205 advances processing to step S1102.

In step S1102, the control unit 205 collates the print conditions set for the target print job with the print conditions stored beforehand in the RAM 208 for determining the print mode.

For example, if the stacker job includes a designation of A4R, then in step S1301 of FIG. 13, the control unit 205 determines that a manual sheet setting is present. Next, the control unit 205 advances processing to step S1302. In step S1302, the control unit 205 collates the determined sheet setting with the print conditions stored in the RAM 208. In this case, the control unit 205 determines that conveying the sheets by the short edge feed is appropriate for the sheet setting A4R. Then, the control unit 205 advances processing to step S1102. In step S1102, the control unit 205 corrects the print job data stored in the RAM 208 so that the target print job can be printed according to the first print mode (the short edge feed mode).

After the print mode is determined, the control unit 205 advances processing from step S1102 to step S1103. In the present exemplary embodiment, the print mode is the first print mode (the short edge feed mode) (FIRST PRINT MODE in step S1103). Therefore, the control unit 205 advances processing to step S1107. In step S1107, the control unit 205 instructs the printer 203 to perform printing according to the first print mode (the short edge feed mode). Then, the control unit 205 terminates the processing of the routine illustrated in FIG. 11.

It is another aspect of above exemplary embodiment that, if a job input to the printing apparatus 100 is the stacker job, the control unit 205 instructs the printer 203 to perform printing according to the second print mode (the long edge feed mode) without regard to the print conditions.

Figure 15:
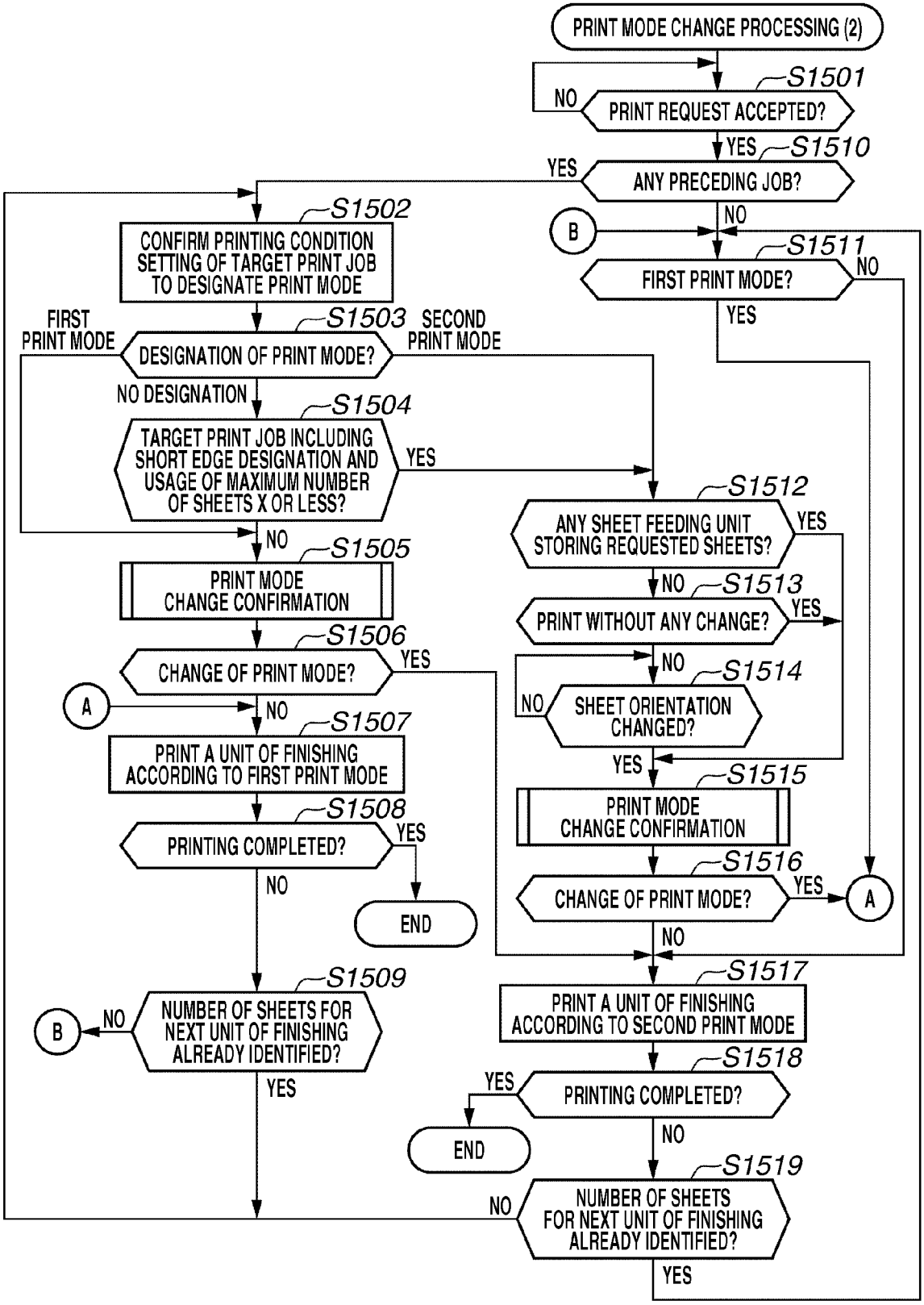
FIG. 15 is a flowchart illustrating a procedure of print mode change processing according to a second exemplary embodiment which can be executed by the printing apparatus illustrated in FIG. 2.

Processing for determining the print mode according to presence or absence of a preceding job is described below. FIG. 15 is a flowchart illustrating a procedure of print mode change processing according to a second exemplary embodiment which can be executed by the printing apparatus 100 illustrated in FIG. 2. More specifically, FIG. 15 is a flowchart for changing the print mode according to the presence or absence of a preceding job.

In FIG. 15, if the control unit 205 receives a print job (YES in step S1501), the control unit 205 advances processing to step S1510. In S1510, the control unit 205 accesses the RAM 208 and confirms whether there is any print job currently executed or in a standby state. If it is determined that a print job is currently executed or in a standby state (YES in step S1510), the control unit 205 advances processing to step S1502.

In step S1502, the control unit 205 confirms a printing condition setting of a target print job to a designate print mode (i.e., the target print job is conveying a sheet in a specific direction). Next, the control unit 205 advances processing to step S1503.

In step S1503, the control unit 205 determines whether a first print mode (the short edge feed mode) is designated, a second print mode (the long edge feed mode) is designated, or no print mode is designated based on the confirmation in step S1502. For example, if the control unit 205 determines that the print job (step 1504) is to convey a sheet according to the first print mode (FIRST PRINT MODE in step S1503), the control unit 205 advances processing to step S1507. In step S1507, the control unit 205 performs printing for a unit of finishing according to the first print mode (the short edge feed mode). A unit of finishing represents one of a plurality of finishing settings included in a single print job.

For example, it is now assumed that there is a print job including processing of 5000 sheets which includes a designation of saddle stitch binding for the first 2500 sheets (i.e., 1 to 2500) and a designation of punching processing for the second 2500 sheets (i.e., 2501 to 5000). In this case, the target print job includes two types of finishing settings.

After the control unit 205 completes the printing for one unit of finishing according to the first print mode (the short edge feed mode), the control unit 205 advances processing to step S1508. In step S1508, the control unit 205 confirms whether the print processing has been completed. In the present exemplary embodiment, the print processing is not yet completed (NO in step S1508). Therefore, the control unit 205 advances processing to step S1509.

In step S1509, the control unit 205 determines whether the number of sheets for next unit of the print finishing is already specified. If it is determined that the number of sheets for the next unit of the print finishing is not yet specified (NO in step S1509), the control unit 205 advances processing to step S1511. If it is determined that the number of sheets for the next unit of the print finishing is already specified (YES in step S1509), the control unit 205 processing back to step S1502.

In step S1502, the control unit 205 determines whether the print mode is designated. In the present exemplary embodiment, the punching processing is set for the second 2500 sheets (i.e., 2501 to 5000). Therefore, the control unit 205 advances processing to step S1503 and subsequently to step S1517.

In step S1512, the control unit 205 confirms whether the sheet feeding unit stores the requested sheets. If it is determined that the requested sheets are set in any of the sheet feeding units (YES in step S1512), the control unit 205 advances processing to step S1515.

If the control unit 205 determines that any of the sheet feeding units does not store the requested sheets (NO in step S1512), the control unit 205 advances processing to step S1513.

In step S1513, the control unit 205 displays the display screen 801 illustrated in FIG. 8 on the touch panel unit 401. In this case, to display the areas 805 and 806, the control unit 205 calculates time required for discharging the sheets required to output the target print job based on the number of sheets and time required to convey a sheet. For example, if the user presses the "PRINT WITHOUT ANY CHANGE (PRINT BY THE SHORT EDGE FEED MODE)" button 802 (YES in step S1513), the control unit 205 advances processing to step S1507. In step S1507, the control unit 205 controls the printer 203 to perform printing according to the short edge feed print mode (i.e., the first print mode). If the user presses the "CHANGE SHEET ORIENTATION BEFORE PRINTING (PRINT BY THE LONG EDGE FEED MODE)" button 803 (NO in step S1513), the control unit 205 displays the display screen 901 illustrated in FIG. 9 on the touch panel unit 401.

When the display screen 901 is displayed, the user changes the orientation of sheets to be used for the printing so that the sheets can be supplied by the second print mode (the long edge feed mode). Then, the user presses the OK button 521. After the OK button 521 is pressed by the user, the control unit 205 advances processing to step S1514. In step S1514, the control unit 205 waits until the user changes the orientation of the sheets.

If the user has changed the orientation of the sheets (YES in step S1514), the control unit 205 advances processing to step S1515. In step S1515, the control unit 205 performs print mode change confirmation processing. After completing the print mode change confirmation processing, the control unit 205 advances processing to step S1516. In step S1516, the control unit 205 accesses the RAM 208 and confirms whether the print mode has been changed.

If it is determined that the print mode has not been changed (NO in step S1516), the control unit 205 advances processing to step S1507. In step S1507, the control unit 205 instructs the printer 203 to perform print processing according to the first print mode (the short edge feed mode). Then, the control unit 205 terminates the processing of the routine illustrated in FIG. 15. If it is determined that the print mode has been changed (YES in step S1516), the control unit 205 advances processing to step S1517. In step S1517, the control unit 205 instructs the printer 203 to perform print processing according to the second print mode (the long edge feed mode). Then, the control unit 205 terminates the processing of the routine illustrated in FIG. 15.

In the present exemplary embodiment, the punching processing is set for the second 2500 sheets (i.e., 2501 to 5000) Therefore, the control unit 205 advances processing from step S1516 to step S1517. Then, the control unit 205 advances processing to step S1518. If in steps S1518 and S1519 it is determined that the print processing relating to the target print job has been thoroughly completed, the control unit 205 terminates the processing of the routine illustrated in FIG. 15.

According to the exemplary embodiments of the present invention, if the number of sheets to be used for an input print job is equal to or greater than a predetermined value and the input print job includes a designation of printing by the short edge feed, the printing apparatus can switch the printing mode to perform printing by the long edge feed. Therefore, the exemplary embodiments of the present invention can improve the print performances.

Further, according to the exemplary embodiments of the present invention, if it is determined that switching the feed direction cannot provide an appropriate output, the printing apparatus performs printing according to user's settings even if the number of sheets to be used for a target print job is equal to or greater than the predetermined value. Therefore, the exemplary embodiments of the present invention can obtain an expected output.

Further, according to the exemplary embodiments of the present invention, comparison with the predetermined number of sheets is performed only when a preceding print job is present. Therefore, the exemplary embodiments of the present invention can prevent execution of the job from being postponed until the total number of sheets required for the print job is specified if no preceding job is present when the print job is input.

Furthermore, according to the exemplary embodiments of the present invention, print times in the first and second print modes that are required for processing the same print job can be displayed on a screen to inform users a degree of improvement in the print performances.

The exemplary embodiments of the present invention can be realized by executing the following processing. A computer-readable storage medium storing a software program code for realizing the functions of the above-described exemplary embodiments can be supplied to a system or an apparatus. A computer (or CPU or micro-processing unit (MPU)) in the system or the apparatus can execute the program code and realizes the functions of the above-described exemplary embodiments.

In this case, the program code itself read out of the storage medium can realize the functions of the present invention. The program code and the storage medium storing the program code constitute the present invention.

A computer-readable storage medium for supplying the program can be selected from any one of a floppy disk, a hard disk, an optical disk, a magneto-optical (MO) disk, a compact disc-ROM (CD-ROM), a CD-recordable (CD-R), a CD-rewritable (CD-RW), a digital versatile disc (DVD)-ROM, a DVD-RAM, a DVD-RW, a DVD+RW, a magnetic tape, a nonvolatile memory card, and a ROM. The program code can be downloaded via a network.

Further, the present invention encompasses a case where the computer executes the read program code and realizes the functions of the above-described exemplary embodiments.

Moreover, the present invention encompasses a case where an operating system (OS) running on a computer can execute a part or all of actual processing based on instructions of the program code to realize the functions of the above-described exemplary embodiments.

Additionally, the present invention encompasses the following processing if the functions of the above-described exemplary embodiments can be realized. Namely, the program code read from a computer-readable storage medium can be written into a memory of a function expansion board inserted in a computer or into a memory of a function expansion unit connected to the computer. In this case, based on instructions of the program, a CPU provided on the function expansion board or the function expansion unit can execute a part or all of the processing to realize the functions of the above-described exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-170750 filed Jun. 30, 2008, which is hereby incorporated by reference herein in its entirety.

What is claimed is:

1. A printing apparatus comprising:

a printing unit configured to perform printing by a short edge feed mode for feeding a sheet in which short side of the sheet is positioned on a leading edge or a long edge feed mode for feeding a sheet in which long side of the sheet is positioned on a leading edge;

an inputting unit configured to input a print job;

a setting unit configured to set an upper-limit value of a number of sheets fed by the short edge feed mode for a print job;

an instruction unit configured to enable a user to instruct to change from the short edge feed mode to the long edge feed mode; and a control unit configured to, in case that a sheet to be fed by the short edge feed mode is designated as a sheet to be used for the input print job and a number of sheets to be used for the input print job is greater than the set upper-limit value, control the printing unit, to perform printing by the short edge feed mode if the user does not instruct to change from the short edge feed mode to the long edge feed mode, and control the printing unit to perform printing by the long edge feed mode if the user instructs to change from the short edge feed mode to the long edge feed mode.

2. The printing apparatus according to claim 1, wherein the control unit determines whether the number of sheets to be used for the print job input by the inputting unit is greater than the upper-limit value set by the setting unit if another print job to be printed before the print job input by the inputting unit is present, and controls the printing unit to perform printing by the short edge feed mode or the long edge feed mode according to print conditions set by a user for the input print job if another print job to be printed before the target print job input by the inputting unit is absent.

3. The printing apparatus according to claim 1, wherein if the sheet to be fed by the short edge feed mode is designated as the sheet to be used for the input print job and the number of sheets to be used for the input print job is greater than the upper-limit value set by the setting unit, the instruction unit causes a display unit to display a screen that enables the user to instruct to change from the short edge feed mode to the long edge feed mode.

4. The printing apparatus according to claim 1, further comprising a display unit configured to display information relating to the print job, wherein if the number of sheets to be used for the input print job is greater than the upper-limit value set by the setting unit, the display unit displays at least one of first display information that enables a user to confirm first requisite time that is required to complete the printing by the short edge feed mode, second display information that enables the user to confirm second requisite time that is required to complete the printing by the long edge feed mode, and third display information that enables the user to confirm that the second requisite time is shorter than the first requisite time.

5. The printing apparatus according to claim 1, wherein if margins in main and sub scanning directions of the short edge feed mode are different from those of the long edge feed mode and if the number of sheets to be used for the print job input by the inputting unit is greater than the upper-limit value set by the setting unit, the instruction unit causes a display unit to display a screen that enables a user to change from the short edge feed mode to the long edge feed mode and to display that a printing area may be varied if the short edge feed mode is changed to the long edge feed mode.

6. The printing apparatus according to claim 1, wherein, if the print job input by the inputting unit is a print job that cause a case binding machine to perform case binding for the sheets printed by the printing unit and even if the number of sheets to be used for the input print job is greater than the upper-limit value set by the setting unit, the control unit controls the printing unit to perform printing by the short edge feed mode.

7. The printing apparatus according to claim 1, wherein, if the print job input by the inputting unit is one of a print job that cause a saddle stitch binding machine to perform saddle stitch binding for the sheets printed by the printing unit and even if the number of sheets to be used for the input print job is greater than the upper-limit value set by the setting unit, the control unit controls the printing unit to perform printing by the short edge feed mode.

8. The printing apparatus according to claim 1, wherein, if the print job input by the inputting unit is one of a print job for stapling the sheets printed by the printing unit and even if the number of sheets to be used for the input print job is greater than the upper-limit value set by the setting unit, the control unit controls the printing unit to perform printing by the short edge feed mode.

9. The printing apparatus according to claim 1, wherein, if the user instructs to change from the short edge feed mode to the long edge feed mode, the control unit waits until the user changes a orientation of the sheets and controls the printing unit to perform printing by the long edge feed mode.

10. A method for controlling a printing apparatus that includes a printing unit configured to perform printing by a short edge feed mode for feeding a sheet in which short side of the sheet is positioned on a leading edge or a long edge feed mode for feeding a sheet in which long side of the sheet is positioned on a leading edge, the method comprising:

inputting a print job;

setting an upper-limit value of a number of sheets fed by the short edge feed mode for a print job;

receiving from a user an instruction to change from the short edge feed mode to the long edge feed mode;

in case that a sheet to be fed by the short edge feed mode is designated as a sheet to be used for the input print job and a number of sheets to be used for the input print job is greater than the set upper-limit value, controlling the printing unit to perform printing by the short edge feed mode if the instruction is not received; and in case that the sheet to be fed by the short edge feed mode is designated as the sheet to be used for the input print job and the number of sheets to be used for the input print job is greater than the set upper-limit value, controlling the printing unit to perform printing by the long edge feed mode if the instruction is received.

11. A non-transitory computer-readable storage medium containing a program for causing a printing apparatus including a printing unit to perform printing by a short edge feed mode for feeding a sheet in which short side of the sheet is positioned on a leading edge or a long edge feed mode for feeding a sheet in which long side of the sheet is positioned on a leading edge, computer-executable instructions of the program comprising:

inputting a print job;

setting an upper-limit value of a number of sheets fed by the short edge feed mode for a print job;

receiving from a user an instruction to change from the short edge feed mode to the long edge feed mode;

in case that a sheet to be fed by the short edge feed mode is designated as a sheet to be used for the input print job and a number of sheets to be used for the input print job is greater than the set upper-limit value, controlling the printing unit to perform printing by the short edge feed mode if the instruction is not received; and in case that the sheet to be fed by the short edge feed mode is designated as the sheet to be used for the input print job and the number of sheets to be used for the input print job is greater than the set upper-limit value, controlling the printing unit to perform printing by the long edge feed mode if the instruction is received.

12. An apparatus for controlling a printing unit configured to perform printing by a short edge feed mode for feeding a sheet in which short side of the sheet is positioned on a leading edge or a long edge feed mode for feeding a sheet in which long side of the sheet is positioned on a leading edge, comprising:

an instruction unit configured to enable a user to instruct to change from the short edge feed mode to the long edge feed mode; and a control unit configured to, in case that a sheet to be fed by the short edge feed mode is designated as a sheet to be used for printing and a number of sheets to be used for the printing is greater than a predetermined value, control the printing unit to perform printing by the short edge feed mode if the user does not instruct to change from the short edge feed mode to the long edge feed mode, and control the printing unit to perform printing by the long edge feed mode if the user instructs to change from the short edge feed mode to the long edge feed mode.

13. A method for controlling an apparatus for controlling a printing unit configured to perform printing by a short edge feed mode for feeding a sheet in which short side of the sheet is positioned on a leading edge or a long edge feed mode for feeding a sheet in which long side of the sheet is positioned on a leading edge, the method comprising:

receiving from a user an instruction to change from the short edge feed mode to the long edge feed mode;

in case that a sheet to be fed by the short edge feed mode is designated as a sheet to be used for printing and a number of sheets to be used for the printing is greater than a predetermined value, controlling the printing unit to perform printing, by the short edge feed mode if the instruction is not received; and in case that the sheet to be fed by the short edge feed mode is designated as the sheet to be used for printing and a number of sheets to be used for the printing is greater than the predetermined value, controlling the printing unit to perform printing by the long edge feed mode if the instruction is received.

14. A non-transitory computer-readable storage medium containing a program for causing an apparatus for controlling a printing unit to perform printing by a short edge feed mode for feeding a sheet in which short side of the sheet is positioned on a leading edge or a long edge feed mode for feeding a sheet in which long side of the sheet is positioned on a leading edge, computer-executable instructions of the program comprising:

receiving from a user an instruction to change from the short edge feed mode to the long edge feed mode;

in case that a sheet to be fed by the short edge feed mode is designated as a sheet to be used for printing and a number of sheets to be used for the printing is greater than a predetermined value, controlling the printing unit to perform printing, by the short edge feed mode receiving from a user an instruction to change from the short edge feed mode to the long edge feed mode;

in case that a sheet to be fed by the short edge feed mode is designated as a sheet to be used for printing and a number of sheets to be used for the printing is greater than a predetermined value.

* * * * *